US010188215B2

(12) United States Patent
Massaud et al.

(10) Patent No.: US 10,188,215 B2
(45) Date of Patent: Jan. 29, 2019

(54) LOUNGE ASSEMBLIES FOR SUPPORTING PORTABLE ELECTRONIC DEVICES

(71) Applicant: Steelcase Inc., Grand Rapids, MI (US)

(72) Inventors: Jean-Marie Massaud, Paris (FR); Robert Arko, San Francisco, CA (US); Jesse Menayan, Sausalito, CA (US); Eric Wendling, Grand Rapids, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 15/431,052

(22) Filed: Feb. 13, 2017

(65) Prior Publication Data

US 2017/0150821 A1 Jun. 1, 2017

Related U.S. Application Data

(63) Continuation of application No. 13/906,642, filed on May 31, 2013, now Pat. No. 9,603,457.

(51) Int. Cl.

| | |
|---|---|
| ***A47C 7/66*** | (2006.01) |
| ***A47C 7/00*** | (2006.01) |
| ***A47C 7/70*** | (2006.01) |
| ***A47C 7/72*** | (2006.01) |

(52) U.S. Cl.

CPC ..... *A47C 7/66* (2013.01); *A47C 7/004* (2013.01); *A47C 7/70* (2013.01); *A47C 7/72* (2013.01); *A47C 7/725* (2013.01)

(58) Field of Classification Search

CPC .... A47C 7/70; A47C 7/66; A47C 7/72; A47C 7/004

See application file for complete search history.

(56) References Cited

U.S. PATENT DOCUMENTS

| | | | |
|---|---|---|---|
| 659,052 | A | 10/1900 | Crenshaw |
| 1,978,512 | A | 10/1934 | Stone |
| 3,050,280 | A | 8/1962 | Regan |
| 3,079,198 | A | 2/1963 | Morgan et al. |

(Continued)

FOREIGN PATENT DOCUMENTS

| | | | |
|---|---|---|---|
| EP | 2373015 | A2 | 10/2011 |
| WO | 2008137362 | A1 | 11/2008 |

(Continued)

OTHER PUBLICATIONS

Addi Design, Booth, http://addi.se/design/?portfolio=booth, Copyright 2010 Addi Design, Kalmar, Sweden, 2 pages.

(Continued)

*Primary Examiner* — Milton Nelson, Jr.
(74) *Attorney, Agent, or Firm* — Quarles & Brady LLP

(57) ABSTRACT

A lounge assembly for supporting a portable electronic device having a display screen in a viewable position, the assembly including a base, a hood including a wall structure that includes an internal surface that forms a substantially downwardly opening cavity, the cavity including a front portion and a rear portion, the cavity opening circumscribed by a lower edge that has a front edge portion adjacent the front portion of the cavity and a support device supported by the base adjacent the front edge portion, the support device configured to receive and support the portable electronic device with the device display screen facing at least one of the cavity and a space below the cavity.

20 Claims, 33 Drawing Sheets

(56) References Cited

U.S. PATENT DOCUMENTS

| | | | | |
|---|---|---|---|---|
| 3,117,534 | A | 1/1964 | Martland | |
| 3,427,768 | A | 2/1969 | Fulton | |
| 3,556,014 | A | 1/1971 | Rudkin, Jr. | |
| 3,762,767 | A | 10/1973 | Powell | |
| 3,842,556 | A | 10/1974 | Brendgord | |
| 4,314,727 | A | 2/1982 | Potts | |
| 4,392,486 | A | 7/1983 | Gardineer et al. | |
| 4,715,154 | A | 12/1987 | Baloga | |
| 4,824,170 | A | 4/1989 | Goldmeier | |
| 4,826,245 | A | 5/1989 | Entratter | |
| 4,858,990 | A | 8/1989 | Combs-Rose et al. | |
| 4,868,888 | A | 9/1989 | Dayton | |
| 4,880,270 | A | 11/1989 | Cooper | |
| 4,915,450 | A | 4/1990 | Cooper | |
| 4,986,330 | A | 1/1991 | McGonagle | |
| 5,024,398 | A | 6/1991 | Riedinger et al. | |
| 5,028,016 | A | 7/1991 | Kelvin et al. | |
| 5,069,504 | A | 12/1991 | Felling | |
| 5,169,210 | A | 12/1992 | Fricano | |
| 5,266,070 | A | 11/1993 | Hagiwara et al. | |
| 5,368,359 | A | 11/1994 | Eakin | |
| 5,380,059 | A | 1/1995 | Felling | |
| 5,564,784 | A | 10/1996 | Felling | |
| 5,572,248 | A | 11/1996 | Allen et al. | |
| 5,573,320 | A | 11/1996 | Shearer | |
| D396,026 | S * | 7/1998 | Arvai | D12/102 |
| 6,145,926 | A | 11/2000 | Lin | |
| 6,205,716 | B1 | 3/2001 | Peitz | |
| 6,248,014 | B1 | 6/2001 | Collier | |
| 6,260,903 | B1 | 7/2001 | von der Heyde | |
| 6,296,408 | B1 | 10/2001 | Larkin et al. | |
| 6,375,259 | B1 | 4/2002 | Ma | |
| 6,549,230 | B2 | 4/2003 | Tosaya | |
| 6,644,736 | B2 | 11/2003 | Nguyen et al. | |
| 6,796,608 | B2 | 9/2004 | Ventimiglia et al. | |
| 6,844,893 | B1 | 1/2005 | Miller et al. | |
| 6,979,056 | B1 | 12/2005 | Goldszer | |
| 6,980,259 | B2 | 12/2005 | Strollo et al. | |
| 7,057,637 | B2 | 6/2006 | White | |
| 7,134,719 | B2 | 11/2006 | Moglin et al. | |
| 7,136,090 | B1 | 11/2006 | McDuffie White | |
| 7,273,251 | B2 | 9/2007 | Real et al. | |
| 7,328,952 | B2 | 2/2008 | Guerrini | |
| 7,379,125 | B2 * | 5/2008 | Chang | B60R 11/0235 296/37.7 |
| 7,566,095 | B2 | 7/2009 | Reeb et al. | |
| 7,621,544 | B2 | 11/2009 | Rossini | |
| 7,760,229 | B2 | 7/2010 | White | |
| D623,577 | S | 9/2010 | Orson et al. | |
| 7,815,254 | B2 | 10/2010 | Reeb et al. | |
| D638,551 | S | 5/2011 | Gann | |
| 7,963,596 | B2 | 6/2011 | Efthimiou | |
| 8,011,138 | B2 | 9/2011 | McGonagle et al. | |
| 8,087,724 | B2 | 1/2012 | Kosik et al. | |
| 8,094,181 | B2 | 1/2012 | Barreiro | |
| 8,141,949 | B2 | 3/2012 | Baru | |
| 8,164,617 | B2 | 4/2012 | Mauchly | |
| 8,169,548 | B2 | 5/2012 | Ryckman | |
| 8,264,519 | B2 | 9/2012 | Lunde et al. | |
| 8,272,674 | B2 | 9/2012 | Vance | |
| 8,274,544 | B2 | 9/2012 | Kurtz et al. | |
| 8,283,801 | B2 | 10/2012 | Petitpierre | |
| 8,289,371 | B2 | 10/2012 | Wagner et al. | |
| 8,292,362 | B2 | 10/2012 | Reeb et al. | |
| 8,300,785 | B2 | 10/2012 | White | |
| 8,319,819 | B2 | 11/2012 | MacDonald et al. | |
| 8,330,791 | B2 | 12/2012 | Gorzynski et al. | |
| 8,416,279 | B2 | 4/2013 | Pepperell | |
| 8,446,449 | B1 | 5/2013 | Miller et al. | |
| 8,446,454 | B2 | 5/2013 | Decker et al. | |
| 8,487,977 | B2 | 7/2013 | Saleh et al. | |
| 8,550,548 | B2 * | 10/2013 | Gibbons | A47D 13/02 297/184.13 |
| 8,864,221 | B1 | 10/2014 | Delvilla | |
| 2008/0143155 | A1 * | 6/2008 | Arnold | A47C 7/725 297/217.4 |
| 2008/0291260 | A1 | 11/2008 | Dignan et al. | |
| 2008/0315734 | A1 | 12/2008 | Birsel et al. | |
| 2010/0085382 | A1 | 4/2010 | Lundqvist et al. | |
| 2010/0245532 | A1 | 9/2010 | Kurtz et al. | |
| 2011/0090302 | A1 | 4/2011 | Leviav et al. | |
| 2011/0102539 | A1 | 5/2011 | Ferren | |
| 2012/0050458 | A1 | 3/2012 | Mauchly et al. | |
| 2012/0140098 | A1 | 6/2012 | Ryckman | |
| 2012/0169096 | A1 | 7/2012 | Chidiac | |
| 2012/0249724 | A1 | 10/2012 | Morrison | |
| 2012/0274727 | A1 | 11/2012 | Robinson et al. | |
| 2012/0281059 | A1 | 11/2012 | Chou et al. | |
| 2012/0306994 | A1 | 12/2012 | Schwartz | |
| 2013/0093838 | A1 | 4/2013 | Tan et al. | |
| 2013/0162749 | A1 | 6/2013 | Eskilsson | |
| 2013/0176450 | A1 | 7/2013 | Pryor | |
| 2013/0194378 | A1 | 8/2013 | Brown | |
| 2013/0222529 | A1 | 8/2013 | Decker et al. | |
| 2013/0277141 | A1 * | 10/2013 | Blankenship | G10K 11/16 181/198 |
| 2014/0150837 | A1 | 6/2014 | Darquea et al. | |
| 2014/0292041 | A1 | 10/2014 | Horowitz | |
| 2015/0016651 | A1 * | 1/2015 | Domash | A47C 7/38 381/333 |

FOREIGN PATENT DOCUMENTS

| | | | |
|---|---|---|---|
| WO | 2010111275 | A1 | 9/2010 |
| WO | 2012173564 | A1 | 12/2012 |
| WO | 2013032461 | A1 | 3/2013 |

OTHER PUBLICATIONS

Buzzispace, BuzziHub, http://www.buzzispace.com/products/buzzihub, Copyright 2013 BuzziSpace, 3 pages.

Cisco Systems, TelePresence: In-Person Experiences for All, http://www.cisco.com/web/telepresence/index.html, Accessed Nov. 4, 2013, 1 page.

EPLUS Advantage, Portable Video Conferencing, http://www.eplus.com/Collateral/Brochures/Portable%20Video%20Conferencing.pdf, Copyright 2012 ePlus Inc., 2 pages.

IVCi, UC Mobile System, http://www.ivci.com/uc-mobile-systems.html, Copyright 2012 IVCi, LLC, 2 pages.

IVCi, UC Room, http://www.ivci.com/uc-room-systems.html, Copyright 2012 IVCi, LLC, 2 pages.

Langer, et al. (Editors), Future Media Rooms & IT Trends: Eclipse a Future Workspace, 2007, http://futuremediaroom.blogspot.com/2007/11/eclipse-future-workspace.html, 2 pages.

Oblong Industries, Mezzanine, http://www.ivci.com/oblong-mezzanine.html, Copyright 2012 IVCi, LLC, 2 pages.

Polycom, Inc., HD Video Conferencing & Telepresence Systems, http://www.polycom.com/products-services/hd-telepresence-video-conferencing.html, Copyright 2013 Polycom, Inc., 3 pages.

Polycom, Inc., RealPresence Experience (RPX), http://www.polycom.com/products-services/hd-telepresence-video-conferencing/realprese . . . , Copyright 2013 Polycom, Inc., 1 page.

Polycom, Inc., Open Telepresence Experience (OTX), http://www.polycom.com/products-services/hd-telepresence-video-conferencing/realprese . . . , Copyright 2013 Polycom, Inc., 1 page.

Polycom, ATX—Architected Telepresence Experience, http://www.ivci.com/polycom-architected-telepresence-experience-atx.html, Copyright 2012 IVCi, LLC, 2 pages.

Polycom, HDX Executive Collection, http://www.ivci.com/polycom-hdx-executive-collection.html, Copyright 2012 IVCi, LLC, 3 pages.

Tandberg Products, Tandberg Video Conferencing, http://vsgi.com/products/videoconferencing/tandberg/, Copyright 2012 VSGI, 4 pages.

Tely Labs, telyHD Pro, TelyMed MTS-100 Mobile Station, http://www.ivci.com/tely-labs.html, Copyright 2012 IVCi, LLC, 2 pages.

* cited by examiner

LOUNGE ASSEMBLIES FOR SUPPORTING PORTABLE ELECTRONIC DEVICES

CROSS REFERENCE TO RELATED APPLICATIONS

This application is a continuation of U.S. patent application Ser. No. 13/906,642, filed May 31, 2013, which is incorporated herein by reference in its entirety.

REFERENCE REGARDING FEDERALLY SPONSORED RESEARCH OR DEVELOPMENT

Not applicable

BACKGROUND OF THE INVENTION

1. Field of the Background

The present disclosure relates to lounge assemblies having features designed to support an electronic device that includes a display screen for use by an occupant of the lounge assembly and to afford a degree of privacy to a lounge occupant when viewing display screen content.

2. Description of the Background

Portable electronic devices, including smart phones and tablets, enable users to view digital content including, for instance, photos, records, documents, videos, films, advertisements, presentations, real time video of friends and colleagues wirelessly linked to the user's device during a video conference or telephone call, etc., and interact with software applications while away from home or an office. Increased accessibility and use of information has, in many cases, substantially increased work efficiencies as employees now have the ability to access and interact with content virtually all the time and regardless of location. Increased accessibility has also substantially increased the use of electronic devices for personal activities such as social networking, photo and video sharing, shopping, entertainment such as watching a movie, etc. Now, virtually any content or a face to face meeting with a remote colleague or friend is only a few gestures or screen interactions away.

While remote access using portable devices clearly has many advantages, there are several disadvantages associated with use of these devices in public. First, because portable devices are often used by people that are travelling, users of these devices often do not have access to a private space while viewing content and interacting with applications. For instance, many portable device users may access content while sitting in a public chair or lounge right next to another person. As another instance, device users may be located at a public table or even standing immediately adjacent a stranger when accessing content. Even in cases where a device user occupies a lounge chair spaced from others in a public space like an airport, other people are often moving about near the user and there is little privacy. In these cases many device users are reluctant to access sensitive information or participate fully in a video conference with others or, if they do fully access or participate, they may disclose sensitive or confidential information to strangers in their general area.

Second, where a portable device user speaks while participating in a video conference in a public space, the user's spoken words are often distracting and annoying to others in the user's general area. For instance, if a video conferee is located at an airport terminal while conversing during a conference, the conferee's voice will often annoy other adjacent people. Similarly, the voices of strangers adjacent or passing by a video conferee are often picked up by the user's device and can be confusing and annoying to the device user as well as to remote conferees. Exacerbating matters, during a video conference in a loud space like an airport terminal, device users tend to increase the volume of their voices when speaking to a relatively small portable device spaced away from the user's mouth in the loud environment and tend to increase the volume of the voice signals generated by their devices.

Third, most portable devices have a flat display screen and most flat display screens are optimally viewed head on (e.g., a user's line of sight is optimally perpendicular to the surface of the display). In addition, during video conferencing, in order to obtain video of a local device user for remote viewing that is most natural, it is optimal to have a portable device camera at about the eye level of the local device user (i.e., in front of the local device user's face). For this reason, for best use, a portable device often has to be supported to be juxtaposed so that the display surface faces a user's face and is perpendicular to the user's line of sight. Often a device user will manually hand hold a device in an optimal position in front of and aligned with the user's face. While this solution works in theory, in reality the solution is not very good as device users cannot maintain a device in the optimal position for very long. In most cases, after just a few minutes, a user hand holding a device experiences fatigue and has to change device juxtaposition or, in many cases, chooses to prop the device up on a table top or lays the device down on a table top so that the viewing angle is poor at best. In other cases a user may have a supporting device such as a device cover that can support the device in a somewhat vertical orientation which, again, is less than optimal.

Fourth, when viewing content on a display screen, ability to view a screen is often hampered by glare on the screen surface from lights or light passing through windows that subtends and reflects off the front of the screen surface. This is particularly true in large public spaces, many of which are intensely lighted and include many windows. While office or home spaces can be optimized to reduce glare, often portable device users do not have the option to customize their space to minimize glare.

Fifth, in cases where a portable device user is using a device for video conferencing, in order to generate optimal video of a local device user for remote conferees to view, a light pattern needs to be shown on the local user that illuminates the user in a certain manner most suitable for generating an optimal image without shadows or other artifacts. In public places lighting is often less than optimal. Similarly, when a device user is using a portable device to access content other than video of a remote conferee, optimal illumination usually includes a different light pattern than required for video conferencing.

To address all of the disadvantages of using portable devices in public spaces that are discussed above, public places would need to have private rooms or cubicle spaces to allow portable device users to use their devices without being overheard, interrupted, or observed and without disrupting or annoying others near the users. Unfortunately, separate rooms or cubicles are expensive and impractical and therefore most operators of public spaces will not provide private rooms for use by the general public.

SUMMARY OF THE DISCLOSURE

It has been recognized that the disadvantages associated with public use of portable devices to access digital content can be substantially overcome by providing a lounge chair that includes a relatively high backrest structure and a portable device support structure having a distal end that resides generally at the optimal location at which a display should be mounted for use by a person occupying the lounge. The high backrest of the lounge itself provides a level of privacy that is unavailable to most standing device users or to a user in a lower back chair. The support structure can maintain the device at an optimal position with respect to the user for content access and interaction as well as for video conferencing. In at least some cases the lounge chair may be mounted for rotation about a vertical axis so that a chair occupant has the option to rotate the chair to face different directions so the occupant can select an optimal direction for creating private conditions during content viewing or telepresence action. For instance, an occupant may choose to face the direction of a public space to hide the display screen of a portable device supported by the lounge assembly or may choose to rotate and face a wall if speaking during a telepresence activity so that the user's voice is more difficult to discern from within a public space behind the lounge backrest.

In some cases the support structure may include a hood that forms a downwardly opening cavity in which, in use, a lounge occupant's head and a display screen of the occupant's portable device are both located. The hood provides additional privacy by blocking line of sight to the occupant's device screen as well as by muffling the occupant's voice or audio from the occupant's device. The hood also blocks or at least substantially reduces at least some sound within a public space about the hood. The hood may include additional component that can be associated with a user's portable device to enhance various activities. For instance, any one or a subset of light devices, speakers, microphones, sensors, scent generating devices, cameras, additional display screens or projectors may be mounted within the hood for enhancing media viewing and listening as well as telepresence activities.

The other components can be optimally arranged within the hood to facilitate the occupant activities. For instance, lights may be arranged to generate optimized light patterns for telepresence activities, for viewing digital media, for viewing hardcopy documents within a lounge occupant's lap, for illuminating at least portions of the hood that are partially translucent to provide a glowing indicator effect to persons outside the hood cavity as a warning that some activity is occurring within the hood, etc. As another instance, speakers and one or more microphones may be mounted within the hood cavity immediately adjacent a space to be occupied by an occupant's head so that the volume of sound or the occupant's voice can be kept low curing telepresence activities. In still other embodiments a large permanent display or projector screen space may be provided within the hood to enhance digital content viewing.

Where a portable device cooperates with other hood components to enhance activities, the portable device may link to the other components either via a cable connection or wirelessly. In this regard, a cable connection or a wireless transceiver may be provided at a location at which a portable device is to be received or stored. For instance, the cable or wireless transceiver may be provided in the hood at a location adjacent a device docking station where the device display is to be used for digital content viewing and telepresence activities. In other cases where a permanent display or projector are provided within a hood, the cable connection or wireless transceiver may be provided within a compartment or at another location that is to receive the user's portable device. Where a wireless transceiver is provided, where a user's portable device has already been used to download a control application, presence of a device may be automatically sensed by the transceiver within a small sensing space proximate the transceiver and a communication connection may be automatically set up between the user's device and other hood components.

Consistent with at least some aspects of the present disclosure, at least some embodiments include a lounge assembly for supporting a portable electronic device having a display screen in a viewable position, the assembly comprising a base, a hood including a wall structure that includes an internal surface that forms a substantially downwardly opening cavity, the cavity including a front portion and a rear portion, the cavity opening circumscribed by a lower edge that has a front edge portion adjacent the front portion of the cavity and a support device supported by the base adjacent the front edge portion, the support device configured to receive and support the portable electronic device with the device display screen facing at least one of the cavity and a space below the cavity.

In at least some cases the support device is configured to receive and support the portable electronic device within the device display screen located within the cavity. In some embodiments the support device is supported within the cavity. In at least some cases the base includes a lounge chair having a backrest and a seat, the assembly further including a bracket mounted to the backrest where the bracket supports the hood substantially above the backrest and at least a portion of a seat.

In at least some cases the bracket includes at least one distal end and wherein the hood is mounted to the distal end of the bracket. In some embodiments the hood is mounted to the backrest for rotation between a lowered position in which the lower edge of the hood is substantially horizontal and a raised position in which the lower edge of the hood is angled upward from the rear portion toward the front portion of the hood. In at least some cases the support device is adjustable to accommodate portable electronic devices of different sizes. In at least some cases the support device includes first and second jaw members and at least one spring biasing mechanism between the jaw members.

In at least some cases the support device includes a mounting portion for mounting to an internal surface of the hood and an adjustable portion supported by the mounting portion for movement among several relatively juxtapositions. In some embodiments the adjustable portion is mounted to the mounting portion for rotation about a substantially horizontal axis so that an angle of the display screen of a portable electronic device mounted to the adjustable portion can be adjusted. In at least some cases the adjustable portion is mounted to the mounting portion for sliding motion with respect thereto so that the height of the display screen of a portable electronic device mounted to the adjustable portion can be adjusted.

In at least some cases, when a portable electronic device is supported by the support device, both the support device and the portable electronic device are disposed within the cavity. Some embodiments further include at least one of an input device and an output device supported by the base within a space defined by the hood and a communication device supported by the base where the communication device links a portable electronic device supported by the support device to the at least one of an input device and an output device so that the at least one input device and output device operates as an input device or an output device for the portable electronic device, respectively.

In some embodiments the at least one of an input device and an output device includes at least one light device mounted to the hood for illuminating at least a portion of the space within the cavity. In at least some cases the at least one light device includes a light device mounted in the front portion of the hood cavity to direct light toward the rear portion. In some embodiments the at least one of an input device and an output device includes at least one speaker mounted within the cavity.

In at least some cases the at least one of an input device and an output device includes at least one microphone. In at least some cases the hood is substantially dome shaped and includes a top cap portion and a side wall portion that circumscribes the cap portion, the cap portion forming a plurality of parallel slots that extend laterally across the cap portion and the side wall portion forming a solid wall structure. In some embodiments the backrest and seat are supported by a pedestal support structure for rotation about a vertical axis, the hood and bracket rotating with the backrest during movement.

Other embodiments include a lounge assembly for supporting a portable electronic device having a display screen in a viewable position, the assembly comprising a lounge assembly including a seat and a backrest member, the seat having an upper support surface and the backrest member having a front surface, a support structure having a distal end and supported by the backrest member for movement between a first position wherein the distal end is generally laterally aligned with a central portion of the backrest member and vertically positioned at a height between 22 and 36 inches above the upper support surface of the seat and a second position wherein the distal end is moved to a side of the space in front of the front surface of the backrest member and a support device supported at the distal end of the support structure, the support device configured to receive and support the portable electronic device with the display screen of the portable electronic device facing the front surface of the backrest member when the support structure is in the first position.

Some embodiments including a hood member that is supported by the backrest member, the hood member forming a substantially downwardly facing cavity, the support device supported within the cavity. In at least some cases the support structure includes the hood member and wherein the distal end includes an internal surface of the hood that forms the cavity. Some embodiments including a headrest extending upward from the backrest member, the display screen of a portable device supported by the support device when the support device is in the first position located at the height of the headrest.

Still other embodiments include a lounge assembly for supporting a portable electronic device having a display screen in a viewable position, the assembly comprising a lounge assembly including a seat, a backrest member and a headrest the backrest member having a front surface; a hood including a wall structure that includes an internal surface that forms a substantially downwardly opening cavity, the cavity including a front portion and a rear portion, the cavity opening circumscribed by a lower edge that has a front edge portion adjacent the front portion of the cavity, the hood mounted to the lounge assembly for rotation between a lowered position in which the lower edge of the hood is substantially horizontal and a raised position in which the lower edge of the hood is angled upward from the rear portion toward the front portion.

Some embodiments further including a pedestal support member, the lounge assembly supported by the pedestal support member for rotation about a vertical axis.

Other aspects and advantages will become apparent upon consideration of the following detailed description and the attached drawings, in which like elements are assigned like reference numerals.

DETAILED DESCRIPTION OF THE DRAWINGS

Figure 1:
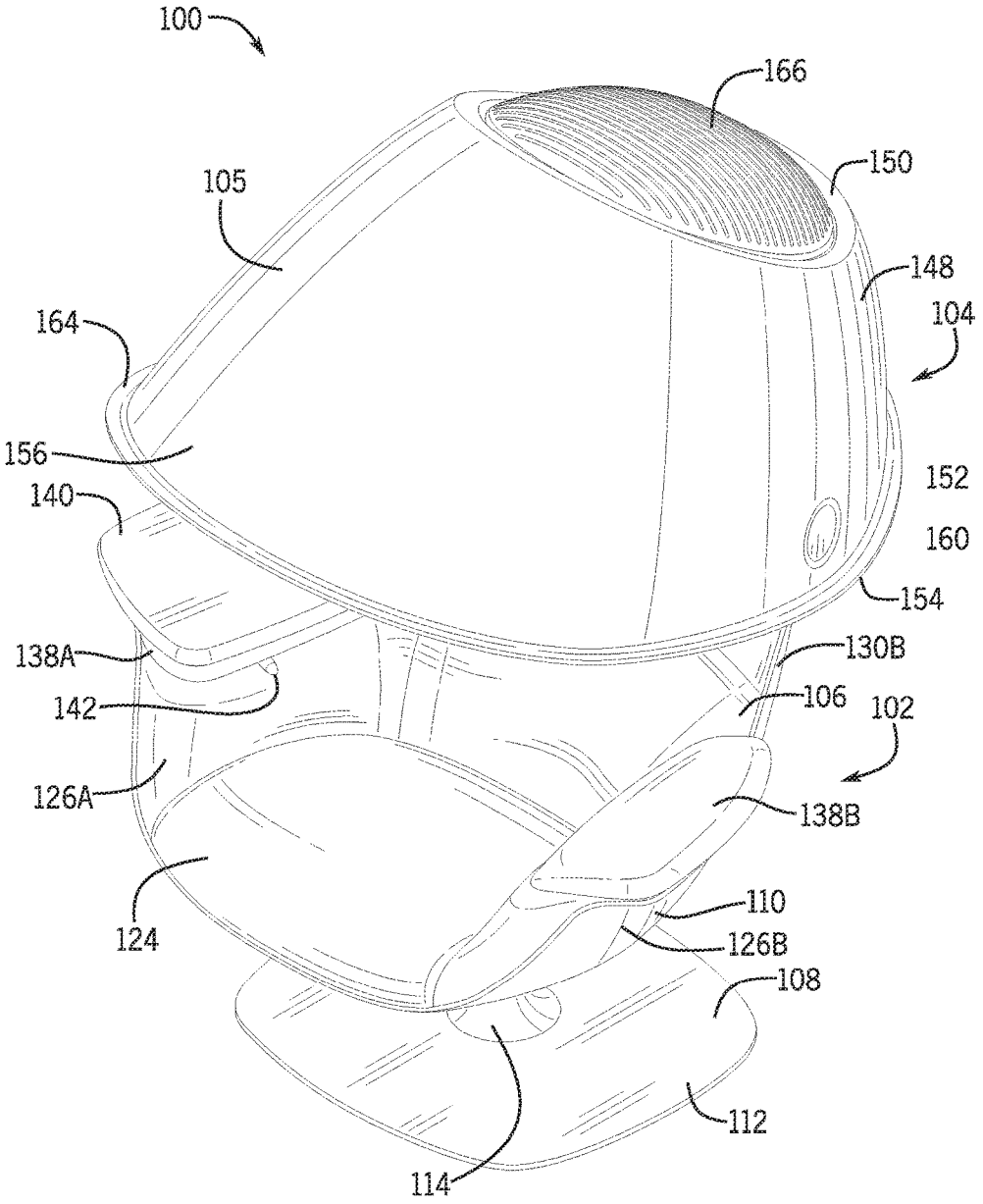
FIG. 1 is an isometric view a hood assembly including a hood and a chair.
Figure 2:
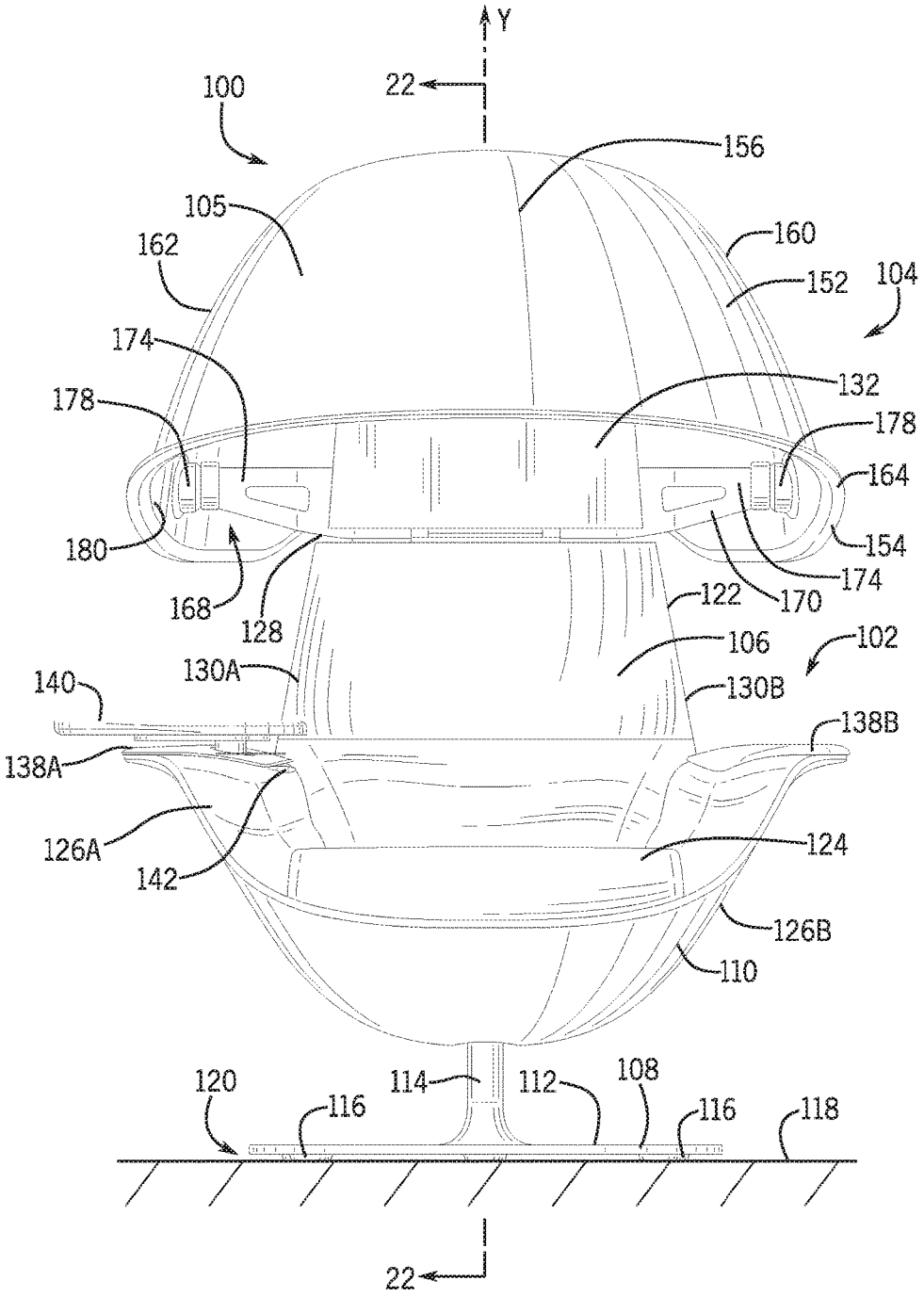
FIG. 2 is a front elevational view of the hood assembly of FIG. 1.
Figure 3:
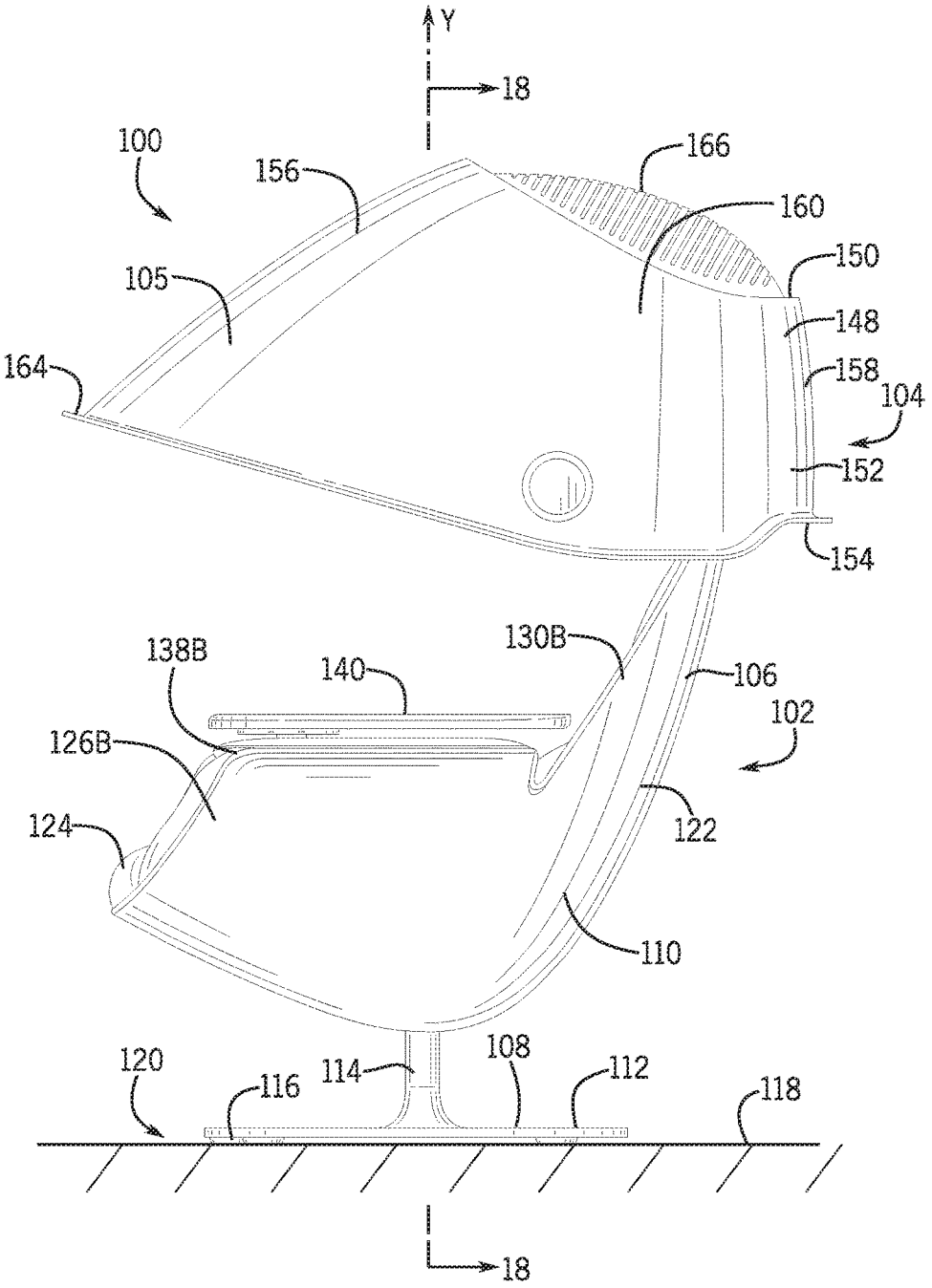
FIG. 3 left side elevational view of the hood assembly of FIG. 1.
Figure 4:
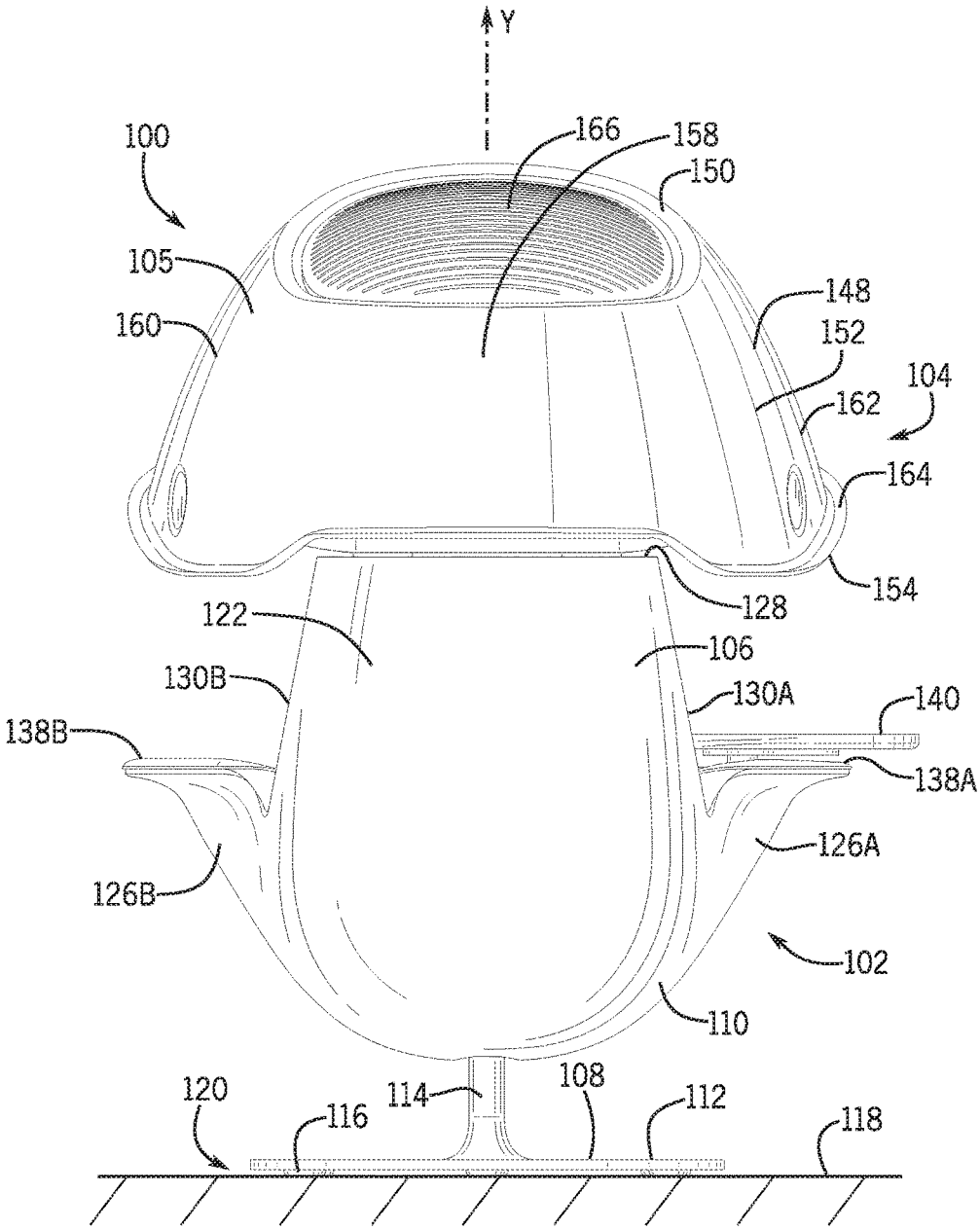
FIG. 4 is a rear elevational view of the hood assembly of FIG. 1.
Figure 5:
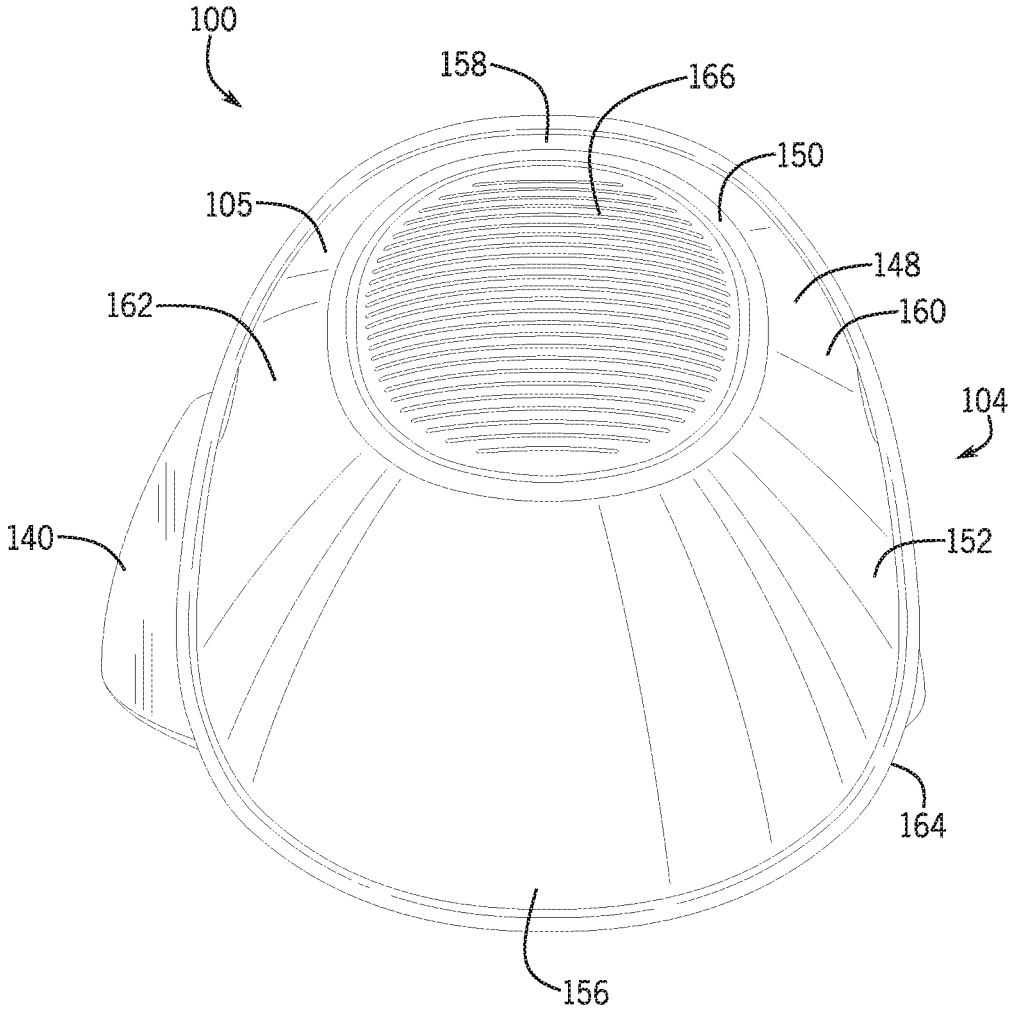
FIG. 5 is a top plan view of the hood assembly of FIG. 1.
Figure 6:
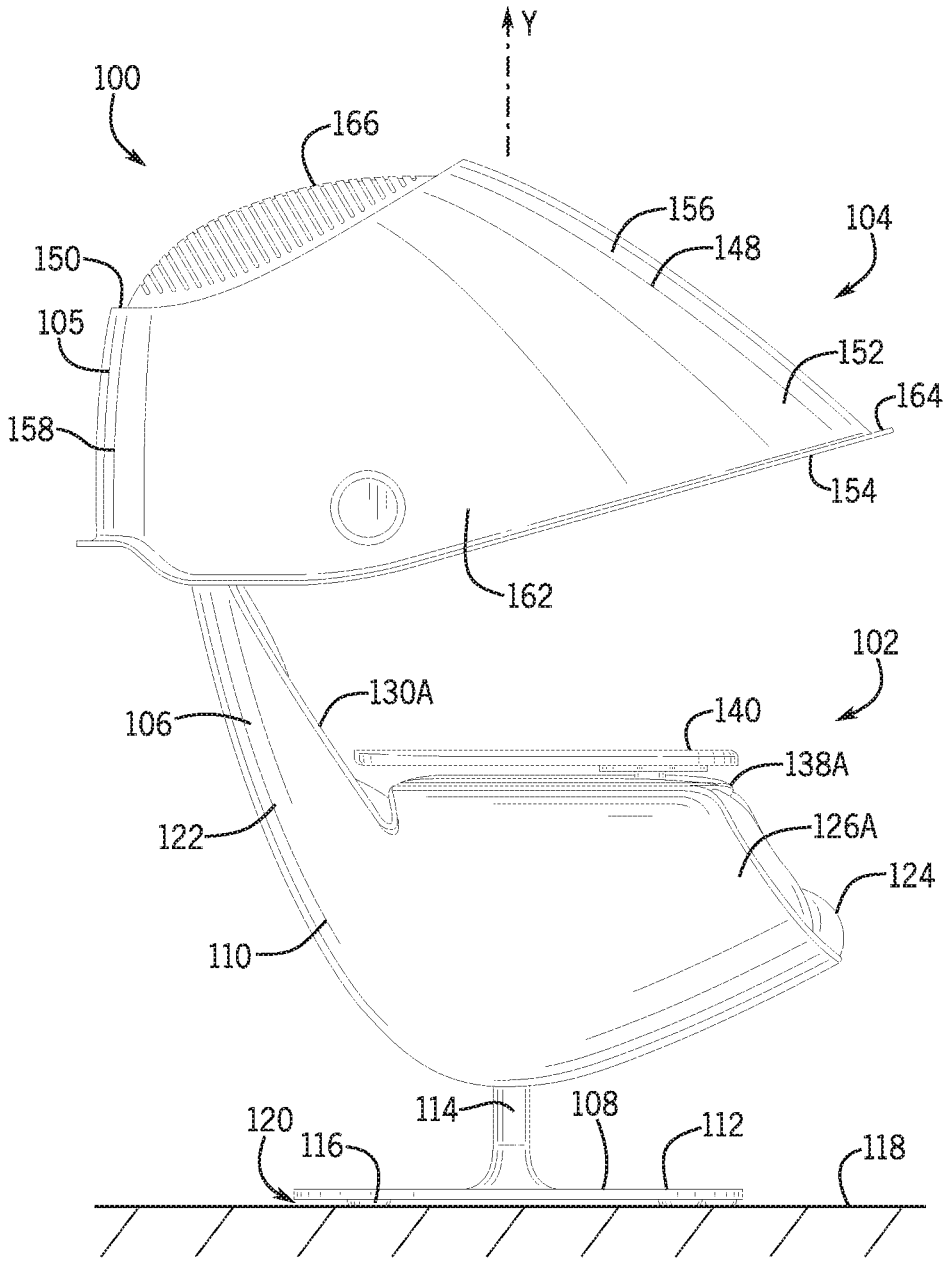
FIG. 6 is a right side elevational view of the hood assembly of FIG. 1.
Figure 7:
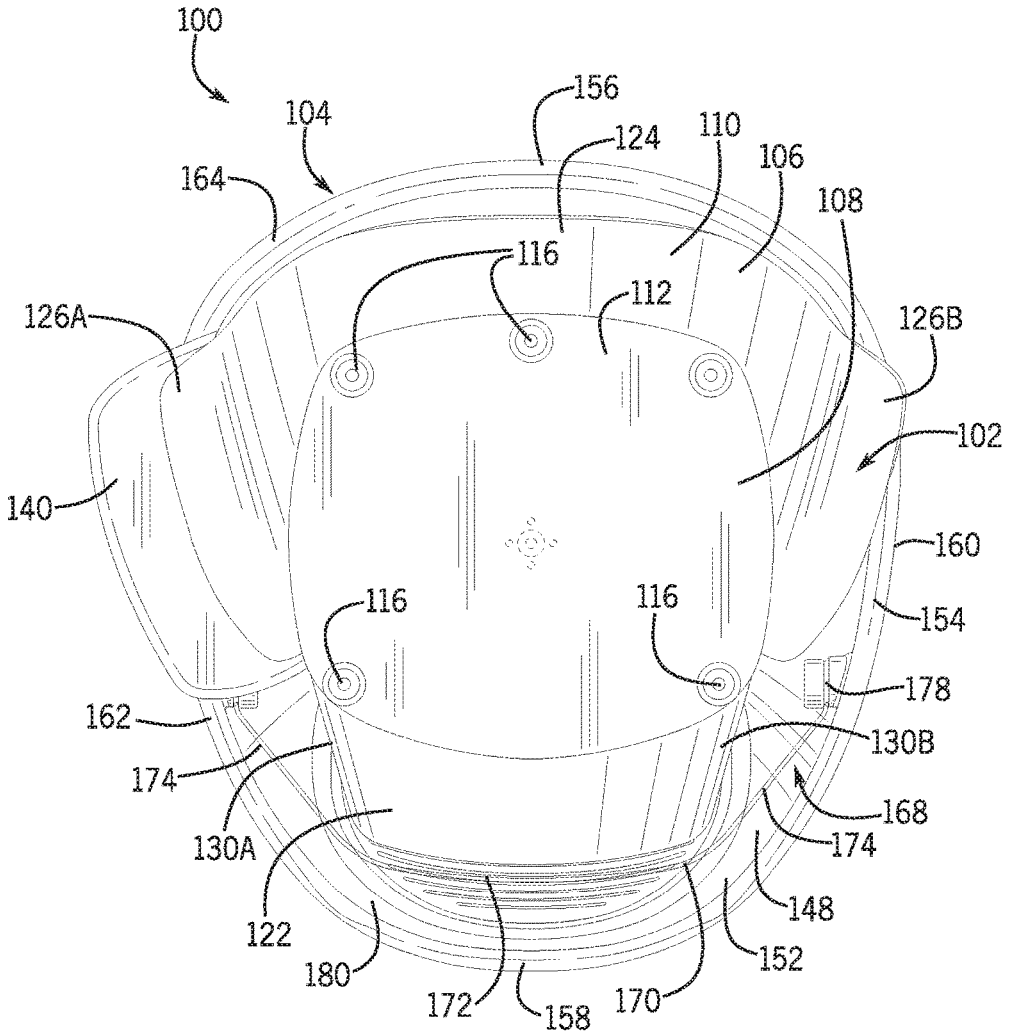
FIG. 7 is a bottom plan view of the hood assembly of FIG. 1.

Referring now to the drawings wherein like reference numerals correspond to similar elements throughout the several views and more specifically to FIGS. 1-7, at least some embodiments that are consistent with at least some aspects of the present disclosure include a hood assembly 100 that may be configured to support a portable electronic device including a display screen such as a smart phone, tablet or pad type computing device, electronic reader, or the like. Exemplary hood assembly 100 includes a base or supporting structure 102 and a hood subassembly 104 rotatably supported by the base structure. In the embodiment shown in FIGS. 1 through 7, base 102 includes a lounge chair 106. In other embodiments it is contemplated that other base types may be used to support the hood subassembly 104.

Referring to FIGS. 1 through 10, exemplary lounge chair 106 includes a pedestal type stand 108, a one-piece seat/backrest shell 110, support cushions (not labeled), a fabric cover (also not labeled) and a headrest subassembly 132. Stand 108 includes a plate member 112 and a pedestal 114 that extends upwardly from a central portion of plate member 112 along a vertical axis Y (see specifically FIGS. 2-4) to an upper end. A plurality of feet 116 are mounted to an undersurface of plate member 112 and rest on a support surface 118. Feet 116 hold plate 112 above support surface 118 thereby creating a gap 120 between the undersurface of plate 112 and the support surface 118. Each foot 116 may including a height adjustable glide that is adjustable by a user to compensate for an uneven support surface thereby eliminating any wobble after assembly and adjustment. Alternatively, it is contemplated that in some embodiments the feet 116 may be excluded such that plate 112 rests directly on the support surface 118. The pedestal 114 and the plate 112 are constructed of metal or a rigid plastic material.

Figure 9:
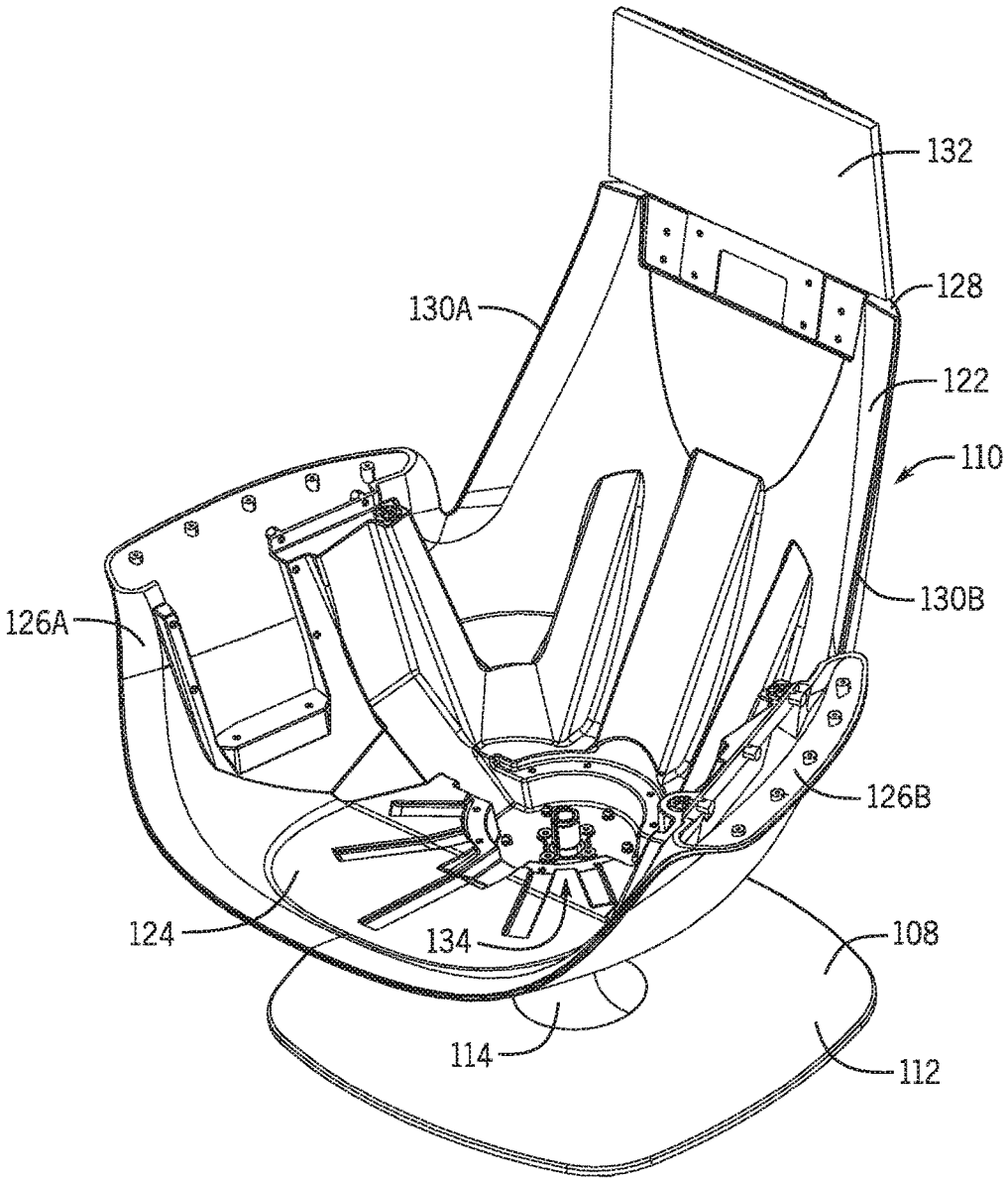
FIG. 9 is an isometric view of a shell and base of the chair of FIG. 8.

Referring still to FIG. 9, one-piece seat/backrest shell 110 includes a backrest portion 122, a seat portion 124, and first and second arm portions 126A, 126B. The backrest portion 122 includes a substantially flat top edge 128 and side edges 130A, 130B, which angle downwardly and forwardly toward arm portions 126A, 126B and forms a shape that is generally concave forward from a top end to a bottom end and concave forward between the side edges 130A and 130B. The first and second arm portions 126A, 126B extend upwardly and angle outwardly from seat portion 124. Shell 110 is generally rigid and forms forward and upward facing surfaces for supporting lounge cushions and the fabric cover as well as a lounge occupant. Shell 110 may be constructed of a rigid plastic, metal, or other rigid material and, in at least some cases, is formed via a molding process. In other embodiments the shell may be replaced by a more traditional frame structure.

Shell 110 forms an opening 134 in the undersurface of a central area of seat portion 124. A metal bushing (not labeled) may be mounted to shell 110 within opening 134 via bolts or other fastening devices where the bushing forms an elongated cylindrical passage for receiving the top end of pedestal 114. In at least some embodiments the bushing and top end of pedestal 114 are designed to facilitate rotation of shell 110 and other components mounted thereto about the top end of pedestal 114 and therefore around the Y axis. To this end, although not shown, one or more ball bearings or other mechanical devices may be provided at the bushing between shell 110 and the top end of pedestal 114 to reduce friction at that juncture and facilitate easy rotation. Structure for mounting a chair for rotation to the top of a pedestal is well known in the office furniture arts and therefore will not be described in greater detail here.

Referring still to FIG. 9, headrest subassembly 132 is attached to shell 110 via bolts or other fastening mechanisms and extends upward from the top edge 128 of shell 110. In at least some embodiments, after installation, headrest subassembly 132 is substantially vertically oriented (see FIG. 21). Exemplary headrest subassembly 132 has a width dimension that is similar to the width dimension of the top edge 128 so that the general lines of the backrest portion of shell 110 are continued upward by the headrest subassembly 132.

Figure 8:
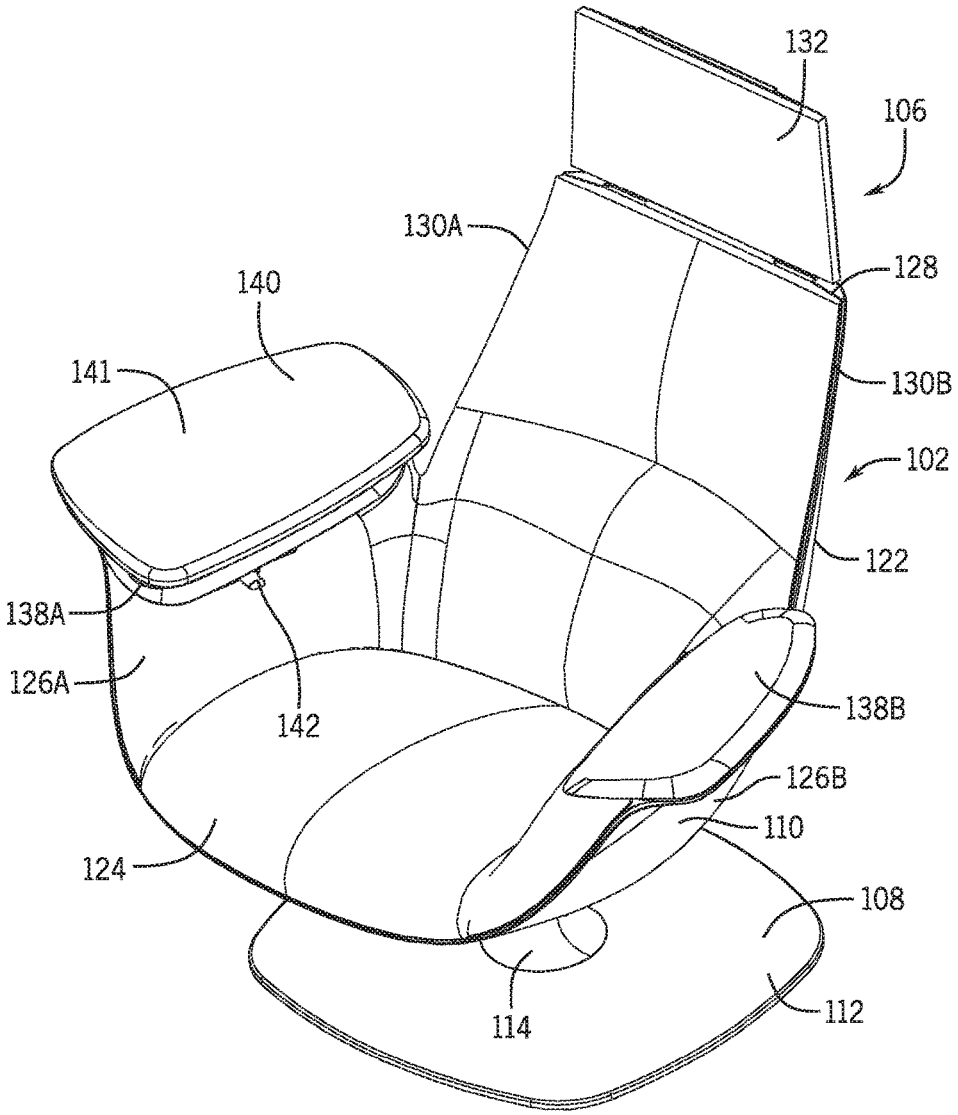
FIG. 8 is an isometric view of the chair of FIG. 1.

Referring now to FIG. 8, shell 110 may be fitted with cushion members and upholstered. In at least some embodiments the cushions and upholstery will only be provided on surfaces of shell 110 that are to support a lounge occupant. For instance, in FIGS. 7 and 8, cushions and the fabric cover are only provided on the front facing surfaces of backrest portion 122, the upward facing surfaces of seat portion 124 and the facing surfaces of the arm portions 126A and 126B. The cushions may be adhered to the supporting surfaces or otherwise mechanically attached. The fabric cover may be adhered, sewn, stapled or otherwise attached.

Referring still to FIG. 8, first and second armrest support members 138A, 138B are disposed on upper ends of first and second arm portions 126A, 126B, respectively. A work surface subassembly 140 is mounted to arm portion 126A where subassembly 140 includes a work surface 141 and a support/mounting structure (not illustrated) mounted to an undersurface of work surface 141. The support/mounting structure holds the undersurface of work surface 141 above armrest support member 138A and allows a lounge occupant to move the work surface between a side or stowed position as in FIG. 8 and a cantilevered use position as in FIG. 10.

To this end, the support/mounting structure includes a release lever 142 (see also FIG. 37) disposed just below the undersurface of work surface 141 that is linked to a latch mechanism within arm portion 126A. The latch mechanism is designed to effectively lock work surface 141 in either of the stowed position or the use position. By pulling lever 142 upward toward the undersurface of work surface 141, the latch is released allowing movement between the two locked positions. Once the latch is unlocked, the support/mounting structure allows movements of work surface 141 to move that surface between the stowed position and the use position. First, upon unlatching, work surface member 141 can be moved forward until a rear portion thereof is above a forward section of arm portion 126A. Second, with the rear portion of work surface member 141 above the front section of arm portion 126A, the front portion of work surface member 141 can be pulled generally toward arm portion 128B and across a lounge occupant's lap to rotate work surface member 141 into the position shown in FIG. 10. This dual motion of member 141 enables movement of member 141 between the stowed and use positions without interference from an occupant resting on the lounge chair 106. In the cantilevered use position, work surface member 141 extends above seat 124 of chair 106.

Figure 10:
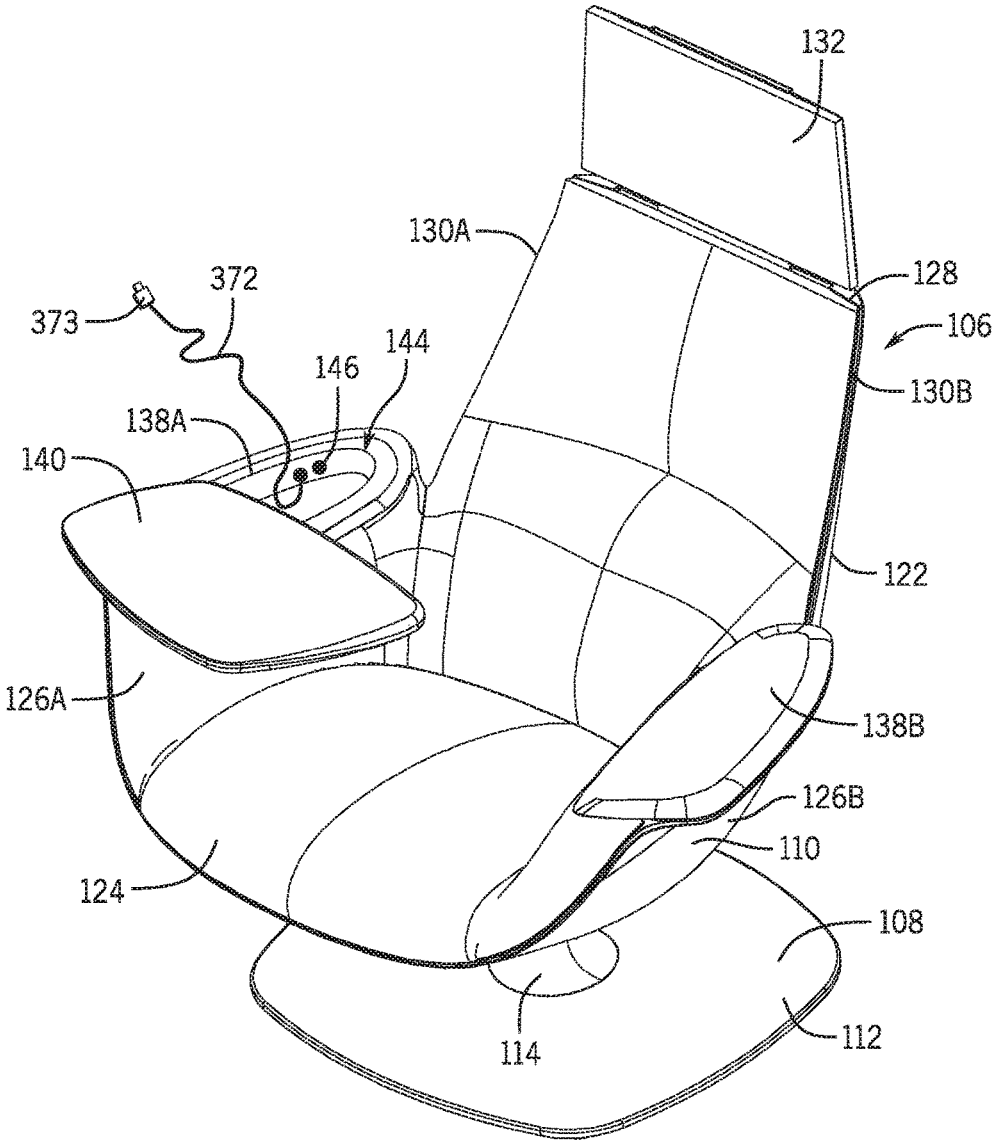
FIG. 10 is an isometric view of the chair of FIG. 8, wherein a desk is shown in the operative position.
Figure 11:
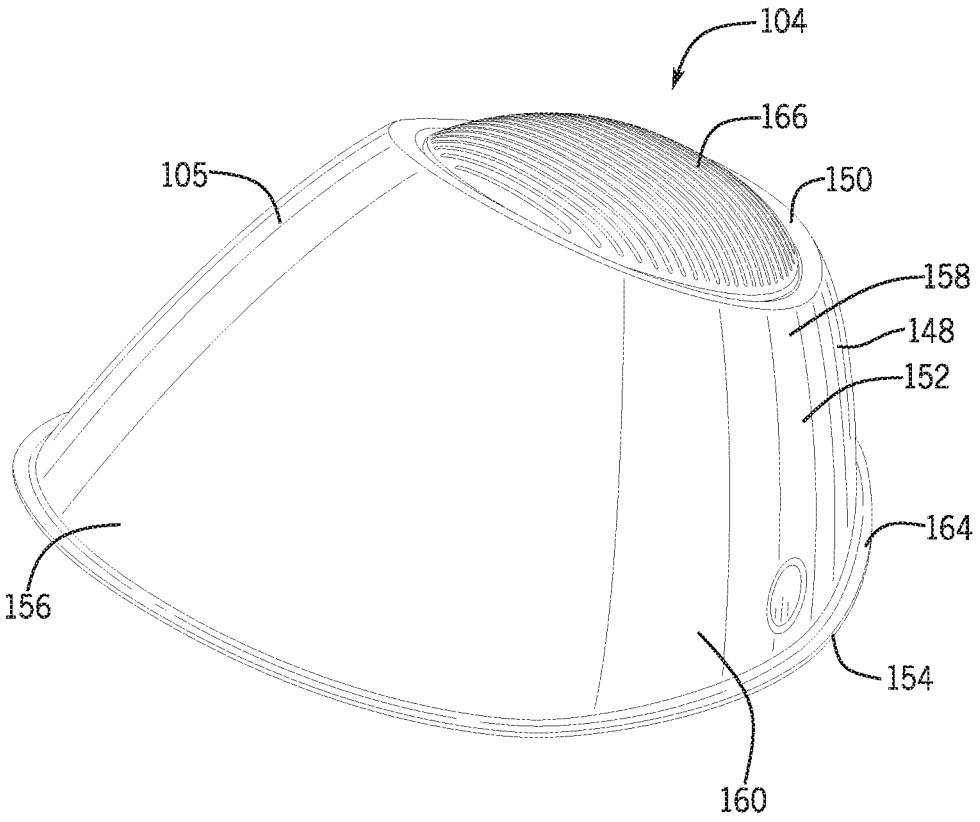
FIG. 11 is an isometric view of the hood of FIG. 1.
Figure 37:
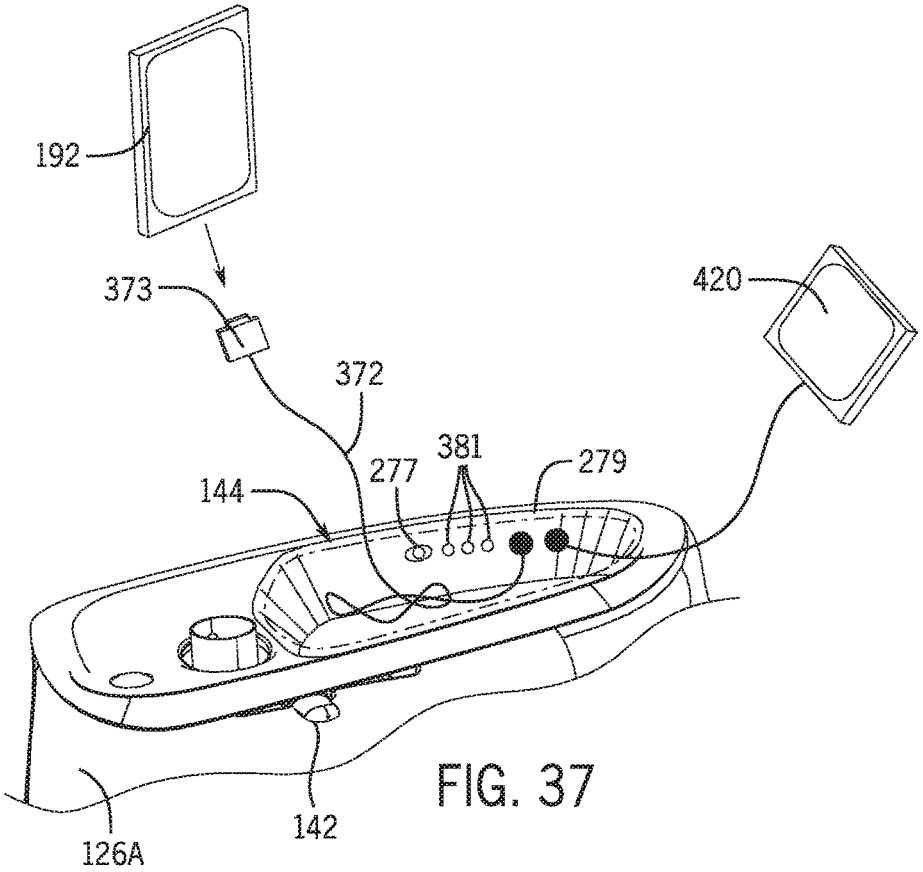
FIG. 37 is a partial view of the arm structure of FIG. 10, albeit where a work surface has been removed.

Referring to FIG. 10 and also to FIG. 37, in at least some embodiments arm portion 126A forms an upwardly opening recess or compartment 144 that is exposed when work surface member 141 is rotated into the cantilevered use position. In some cases compartment 144 may simply be a space for storing small items like pens, a small note book, etc. In other cases various power and/or data connection ports or cables may be provided within compartment 144 for linking to a portable electronic device. For instance, one or more USB ports, audio ports, video connection cables, power/charging ports or cables, etc., may be provided within compartment 144. Exemplary ports are labeled 381 and an exemplary connector cable is labeled 372/373 in FIG. 37. At least some of the ports may be usable to obtain information from a portable device to drive various features of assembly 100 to be described in greater detail below. For instance, at least some embodiments of assembly 100 may include lighting or speakers within hood assembly 104 and an application on a user's portable device may be programmed to drive those components upon linkage via cable 372/373 or the like. Other capabilities are contemplated.

In other embodiments some type of control device may be provided within compartment 144. For instance, in some embodiments described below, a lounge occupant may mount or support a portable electronic device including a display within hood assembly 104 for use by the occupant. Here, where the display is mounted at head height and a distance from the occupant's face, touch interaction with the display may be tiresome and may even cause the occupant discomfort over an extended period. To avoid this problem, an interface device may be provided within compartment 144 allowing very basic control of the portable device in a more ergonomically correct manner. For example, referring again to FIG. 37, one interface may include a pad 420 tethered to a port in compartment 144 that can be pulled out and supported on the top surface of work surface member 141 where pad 420 enables a user to move a selection cursor around on a portable device display screen to control device functions.

In still other embodiments it is contemplated that work surface member 141 may include a touch sensitive input surface like the ones provided on many laptop computers or a touch sensitive emissive surface or emissive surface portion to enable interaction with an application operating on a portable device supported within the hood assembly 104 to control display content.

All of the functionality described above with respect to compartment 144 may be provided in the other arm portion 126B under a hinged armrest member 138B in some embodiments.

Turning now to FIGS. 11-17, exemplary hood assembly 104 includes a hood member 105 (also referred to hereinafter as a hood) and a mounting bracket 170. Hood 105 comprises a generally helmet-shaped or thimble-shaped body structure 148 that forms a downwardly opening recess or cavity 168 (see specifically FIG. 12) defined by an internal surface and that is circumscribed by a lower hood edge 154. Body structure 148 includes a slightly concave sidewall 152 and a vented ceiling cap portion 166. Sidewall 152 extends downward from a top edge 150 to lower edge 154 where top edge 150 truncates the general shape of the sidewall 152. The truncated top end of the hood body is located closer to a rear portion 158 of the hood 105 than a front portion 156 (see FIGS. 14 and 15) such that, when viewed from the right and left sides, the front portion 156 extends further outwardly from the truncated top end than the rear portion 158.

Figure 12:
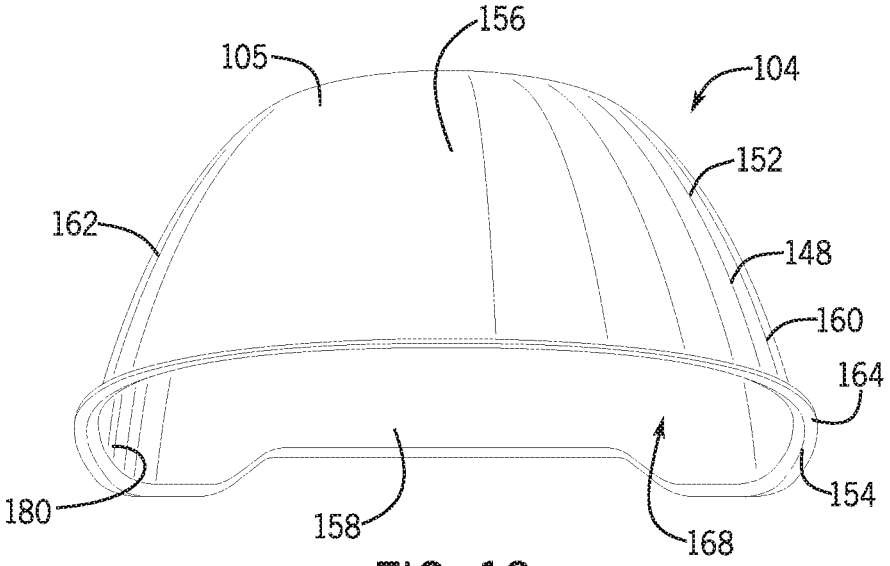
FIG. 12 is a front elevational view of the hood of FIG. 11.
Figure 13:
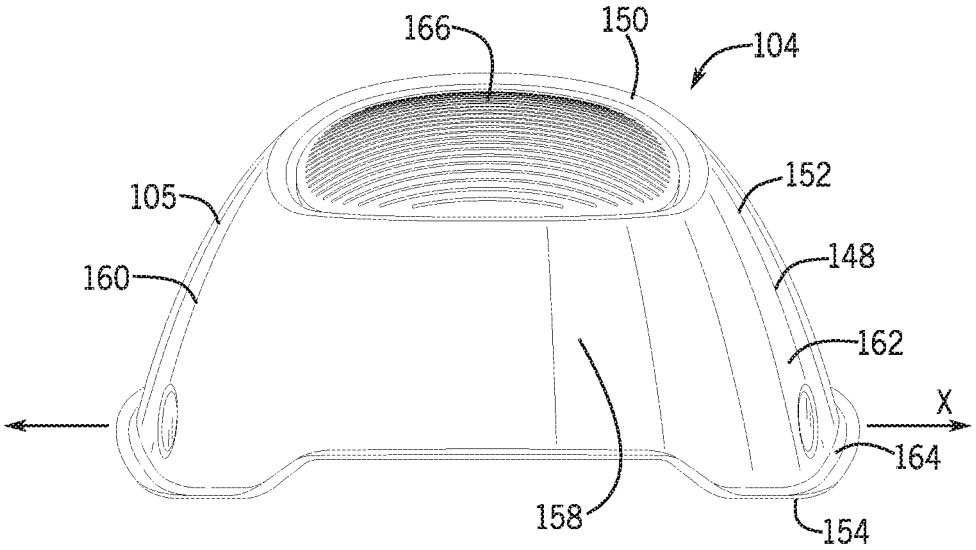
FIG. 13 is a rear elevational view of the hood of FIG. 11.
Figure 16:
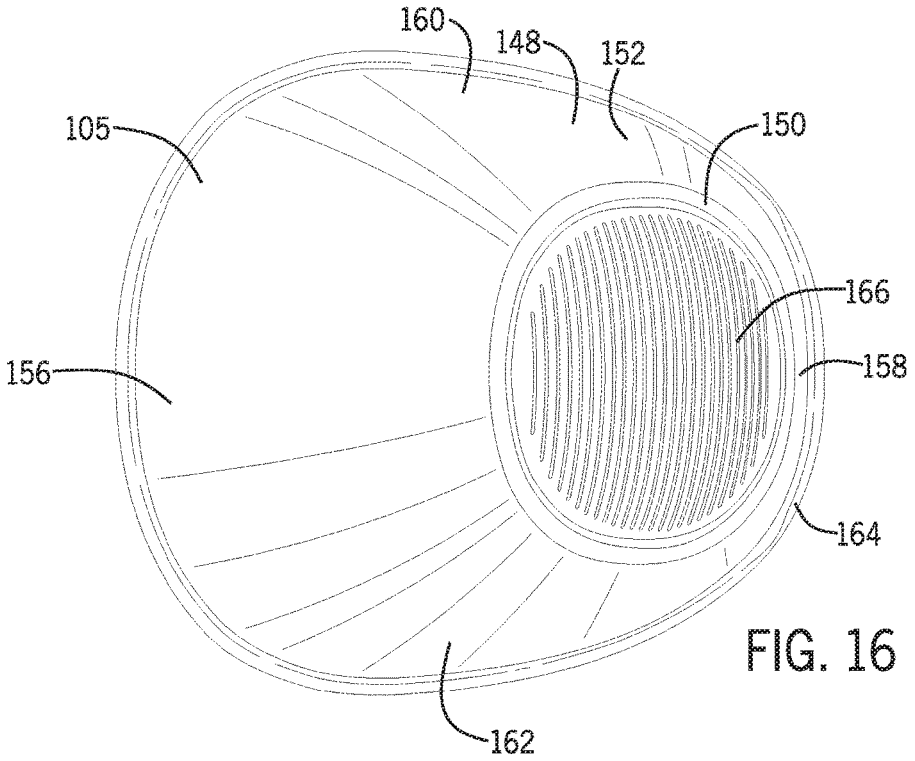
FIG. 16 is a top plan view of the hood of FIG. 11.
Figure 17:
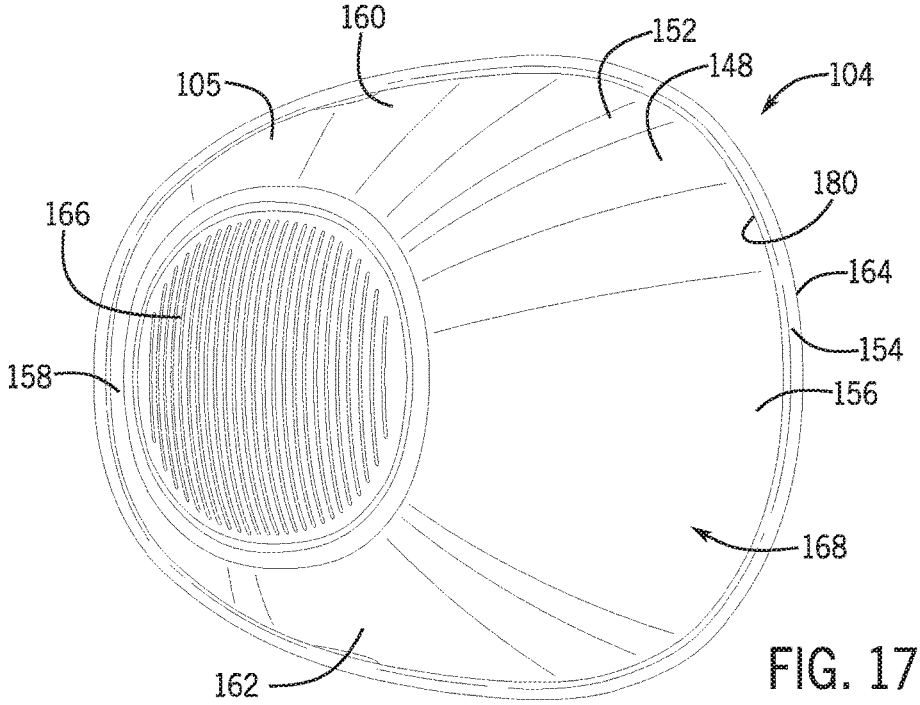
FIG. 17 is a bottom plan view of the hood of FIG. 11.

Referring to FIGS. 12 and 13, when viewed from the front and rear, left and right portions 160, 162 of the sidewall 152 extend downwardly from the top end 150 the same distance and have the same radius of curvature, such that the left and right side portions 160 and 162 of hood 105 are symmetrical about a bisecting plane. Referring to FIGS. 16 and 17, when viewed from the top or bottom, hood 105 has the shape of a lopsided oval such that the body 148 of hood 105 is substantially more bulbous adjacent the front portion 156 than the rear portion 158.

Referring to FIGS. 12 through 15, a flange 164 extends generally outwardly around a perimeter of sidewall 152 adjacent lower edge 154. The flange 164 may be between one-half inch and substantially three inches and may provide a gripping surface or structure to assist a user in raising and lowering the hood 105 between different positions as described below. Some embodiments may not include flange 164.

Vented ceiling cap portion 166 is provided within the space defined by top edge 150 and generally closes off that space. Cap portion 166 is generally convex downward and forms a plurality of parallel slots that extend from side to side as best illustrated in FIGS. 16 and 17. The cap portion slots allows air to flow through and light to enter hood cavity 168 to provide for a more comfortable environment during use. The slots in cap portion 166 are positioned and designed in at least some embodiments such that a person behind and generally above cap portion 166 looking through the slots does not have a direct line of sight to the interior surface of hood 105. In other words, the slots operate as a collimator for a person's view into the cavity 168 formed by hood 105 and restrict the person's view.

Figure 14:
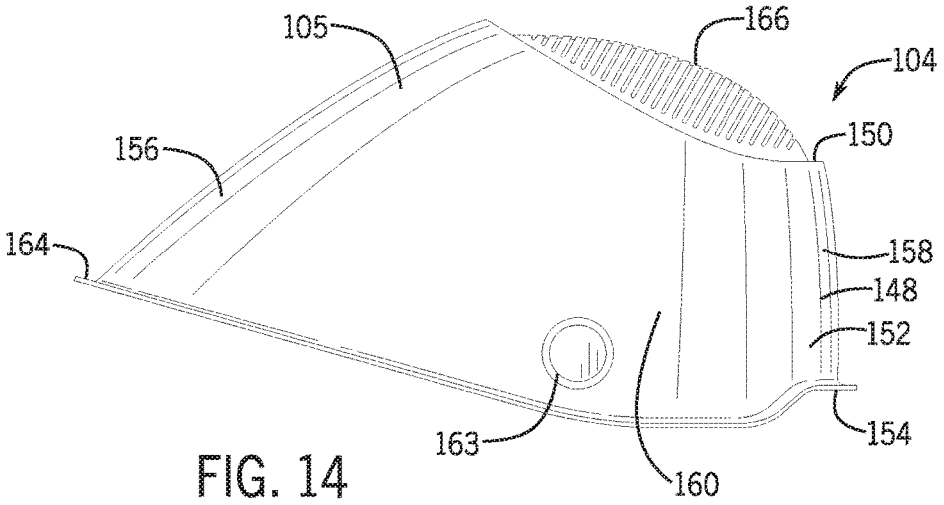
FIG. 14 is a left side elevational view of the hood if FIG. 11.
Figure 15:
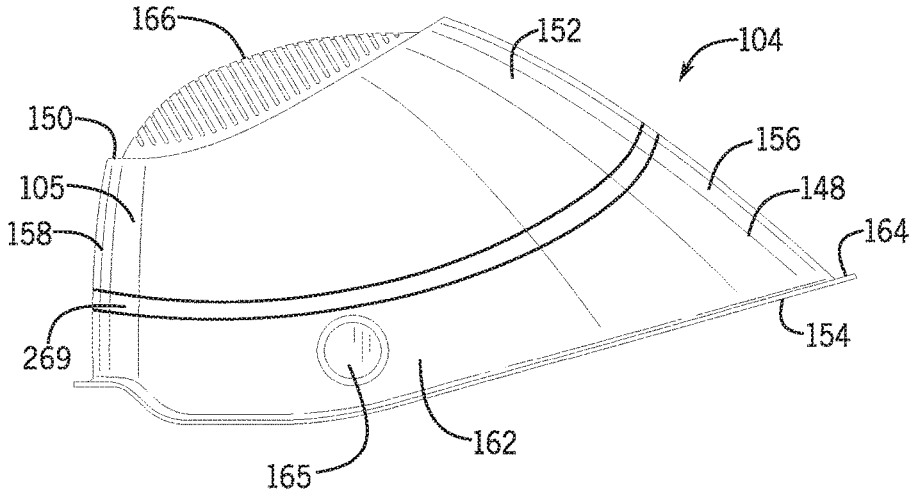
FIG. 15 is a right side elevational view of the hood of FIG. 11.

Cap portion 166 may be covered in a stretch or fitted fabric, a mesh material, or other breathable material to enhance aesthetics while still allowing air and light to enter the interior cavity 168 of hood 105. Alternatively, it is contemplated that cap portion 166 may be removed from the hood 105. As shown in FIGS. 14 and 15, while cap portion 166 generally continues the curved shape of the external surface of sidewall portion 152, the external surface of cap portion is somewhat recessed from the external surface of sidewall 152 so that the sidewall 152 stands proud of cap portion 166.

The hood body structure 148 may be constructed of any rigid material including but not limited to plastic, metal, pressed recycled paper, pressed polyethelane terephthalate (PET) or other fibers, resin impregnated fabrics, etc. In at least some embodiments the material will be molded into the final hood shape. One advantageous hood 105 may be formed using four layers of PET fiber. The base substrate layer may be composed of 2 layers of 1200 gsm polyester fiber. A color controlled inner and outer layer may be made of 300 gsm polyester fiber. In other embodiments, after a basic hood structure is formed, a fabric or other sound deadening material or batting may be added to the hood structure to minimize the effects of sound outside cavity 168 on a user's ability to hear sounds generated within cavity 168. The sound deadening material may also be designed to reduce the volume of the voice of a person speaking inside cavity 168 at locations external to cavity 168. In other embodiments hood body 148 may be formed by constructing a skeletal frame structure and stretching one or more layers of sound deadening material or sight blocking material around external surfaces of the frame structure.

While hood 105 is illustrated as being generally helmet-shaped in the FIG. 1 through 10 embodiment, it is contemplated that hood 105 may have many other shapes. For instance, hood 105 may be dome-shaped, rectangular (e.g., like a box) or may have some other appealing geometric shape.

Figure 18:
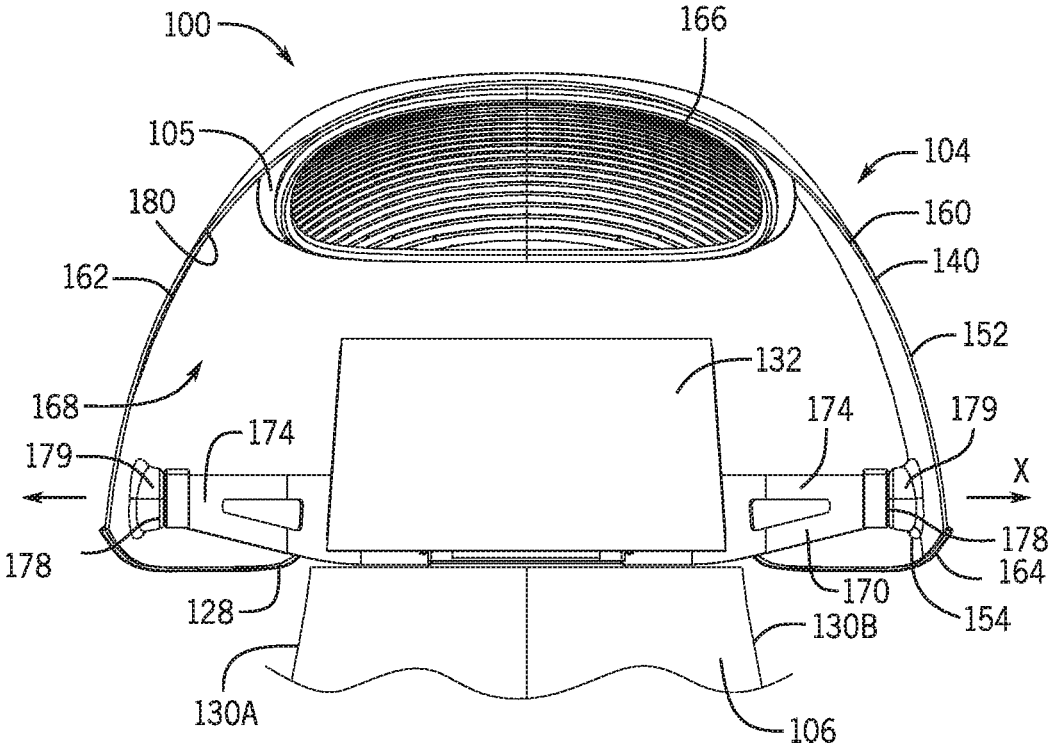
FIG. 18 is a partial cross-sectional view of the hood assembly taken along the line 18-18 of FIG. 3.
Figure 21:
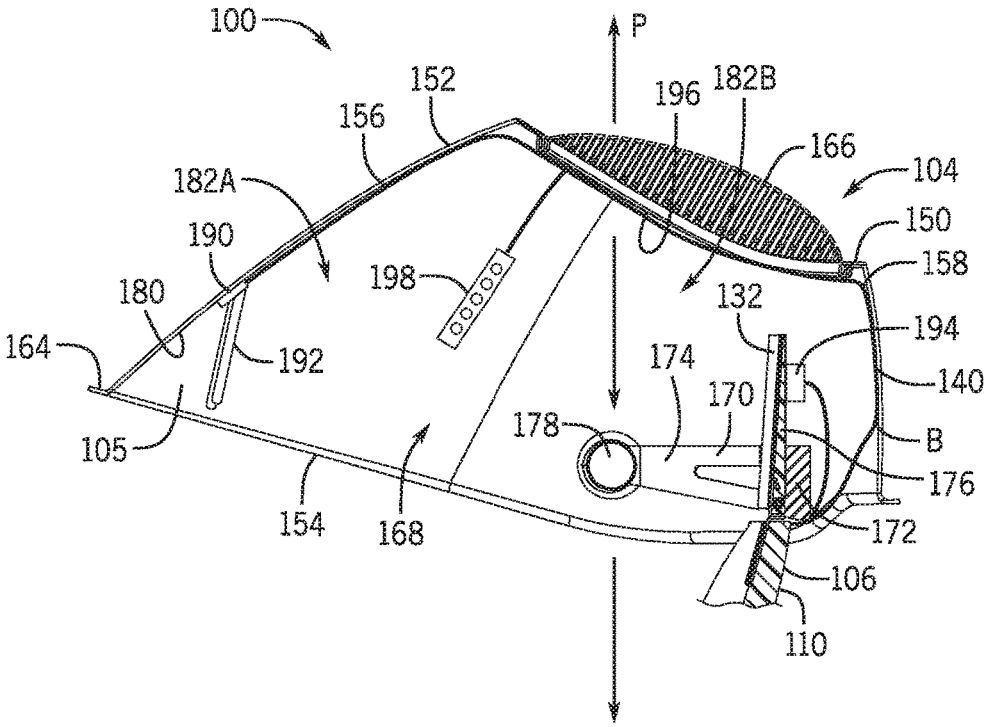
FIG. 21 is a partial cross-sectional view of the hood assembly taken along the line 21-21 of FIG. 2.
Figure 22:
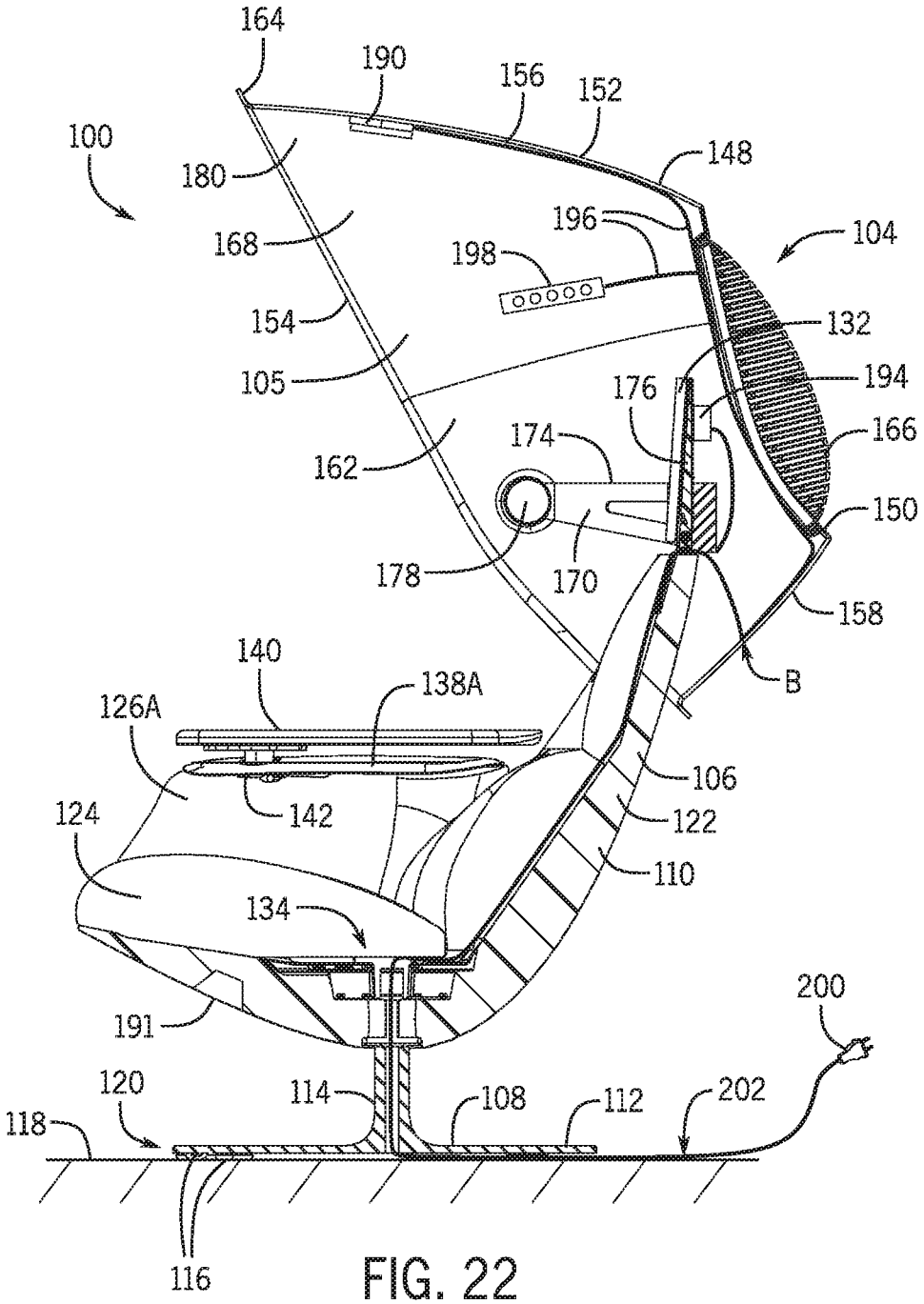
FIG. 22 is a cross-sectional view of the hood assembly similar to FIG. 21, wherein the hood assembly is shown in the raised position.

Referring now to FIGS. 18, 21, and 22, hood 105 attaches to base 102 via bracket 170. The bracket 170 generally includes a shoulder member 172 and two tension arms 174 extending therefrom. The arms 174 may be formed integrally with shoulder member 172 by bending a piece of sheet metal into the desired shape or may be formed via a molding process. The arms 174 have distal ends 178. The shoulder member 172 attaches centrally to a rear surface 176 of the head rest 132. Any mechanical fastening structure can be used to secure shoulder member 172 to rear surface 176. For instance, bolts or screws may be used to attach shoulder member 172 to surface 176. Once bracket 170 is mounted to headrest subassembly 132, bracket 170 is stationary relative to member 132. After installation, tension arms 174 extend around the sides of and forward of the head rest 132 to distal ends 178.

Referring still to FIGS. 18, 21 and 22, hood 105 is placed generally over headrest 132 and bracket 170 so that headrest 132 and bracket 170 are located within cavity 168. Distal ends 178 of bracket 170 attach to left and right side portions 162 and 160 of the internal surface of hood 105 at locations generally identified by numerals 165 and 163 to support hood 105 above lounge chair 106.

Figure 19:
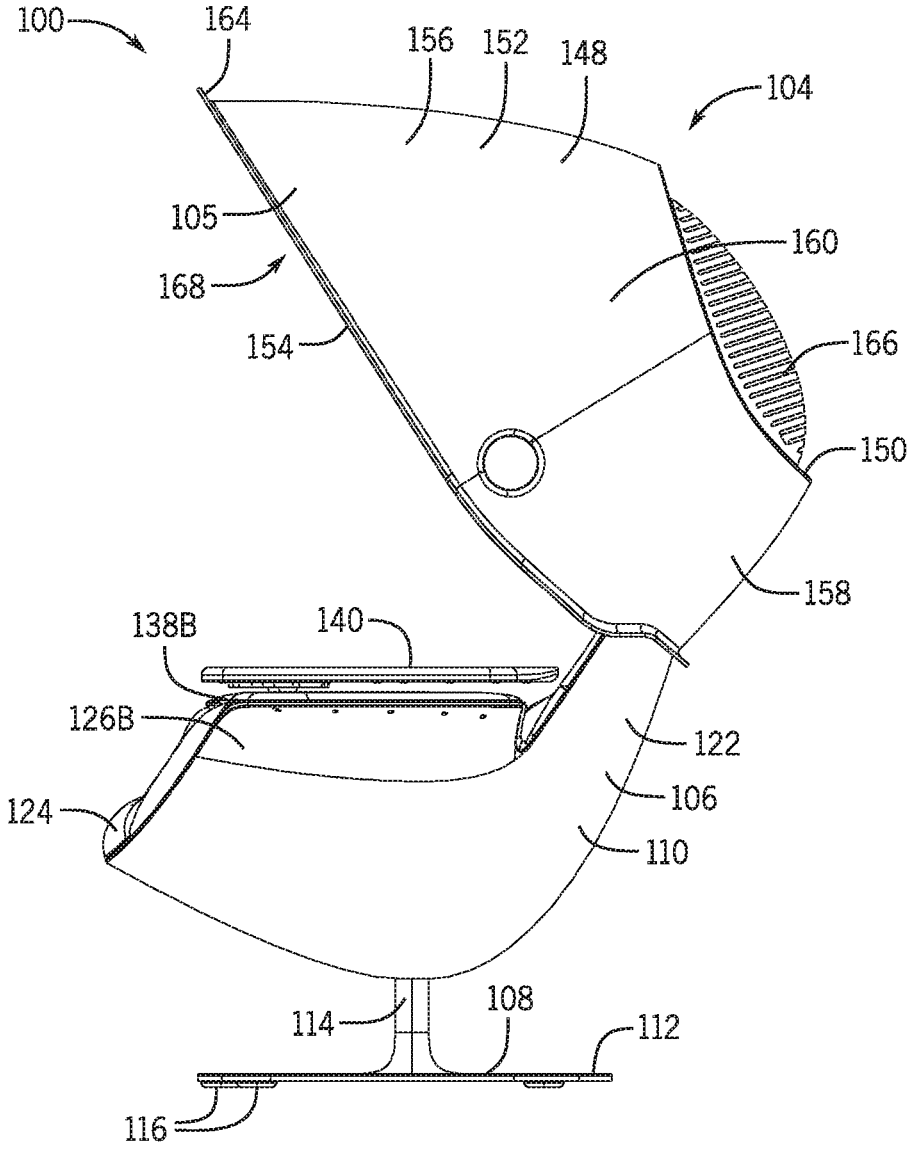
FIG. 19 is a left side elevational view of the hood assembly, wherein the hood is shown in a raised position.
Figure 20:
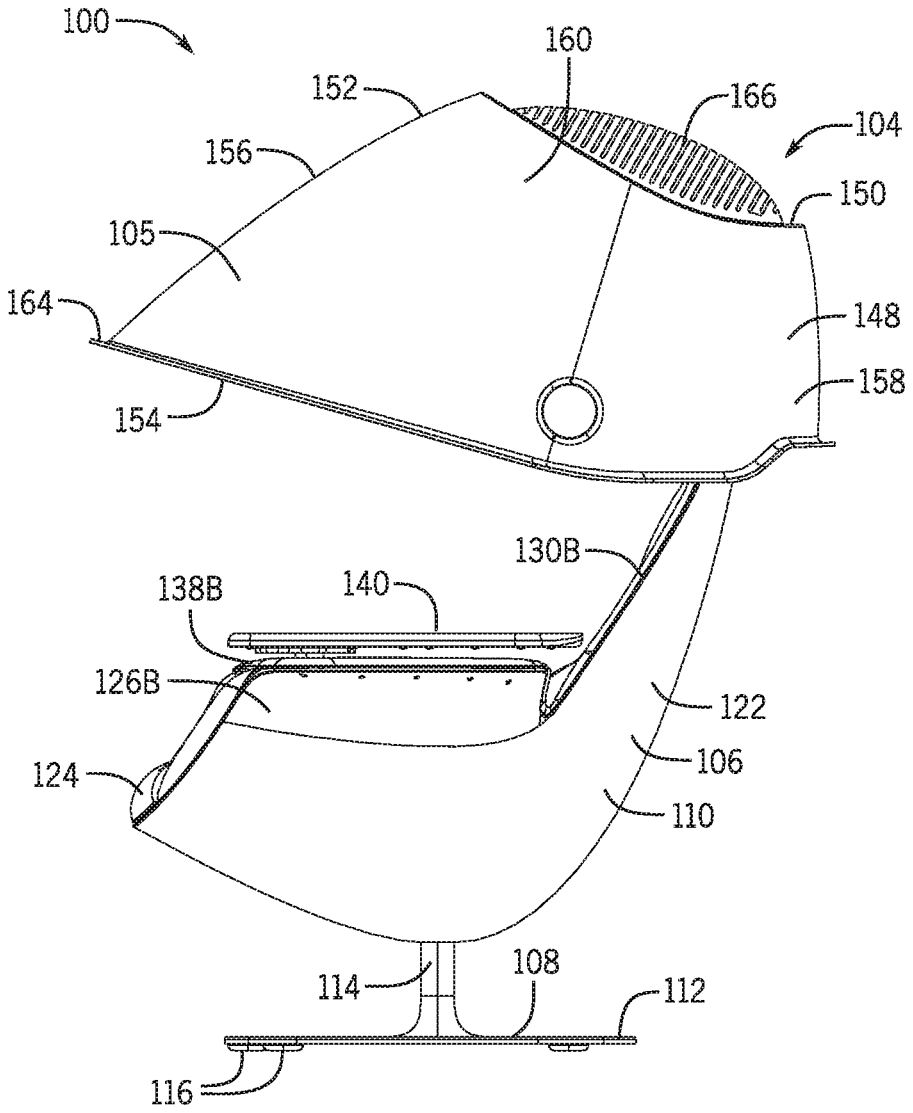
FIG. 20 is a left side elevational view of the hood assembly, wherein the hood is shown in a lowered position.

In at least some embodiments, hood 105 is supported by the distal ends 178 of bracket 170 such that hood 105 can rotate about a horizontal axis X passing through areas 163 and 165 between an open or raised position shown in FIG. 19 and a closed or lowered position shown in FIG. 20. To this end, in some cases, cylindrical posts 179 (see specifically FIG. 18) may be integrally formed or otherwise attached to the internal surface of hood 105 at locations 163 and 165 where each post 179 forms a cylindrical wall that extends into cavity 168 and that is generally centered along the X axis. Circular flanges 181 may be provided at distal ends 178 that are friction fit into the openings formed by posts 179 where the weight of hood 105 can balance in the fully raised or fully lowered positions as the hood weight seesaws back and forth during rotations between the two positions.

In other cases friction within the structure at distal ends 178 may be sufficient to support hood 105 in steady state in any position between the fully raised and fully lowered positions, thereby providing a user the capability to move hood 105 to different positions to achieve multiple degrees of privacy. In still other cases ball bearings, bushings, washers, or other friction reducing mechanical structure may be provided at distal ends 178 to facilitate reduced friction rotation. A mechanical locking structure may also be provided at one or both distal ends 178 for locking hood 105 in a set position. In still other embodiments one or more helical, gas, compression or other types of springs or other loading devices may be provided at distal ends 178 or within arms 174 to assist in raising hood 105 to the raised position upon application of an upward force at front edge 164 and/or to assist in lowering hood 105 in a controlled fashion.

Referring again to FIGS. 18 and 21, when hood 105 is in the lowered position, the horizontal axis X and a vertical direction define a plane P that separates the hood into front and rear hood sections 182A, 1826, respectively. Additionally, in the lowered position, the lower edge 164 of the front portion 156 of the sidewall 152 is located directly in front of or slightly lower than headrest subassembly 132, thereby fully hiding an occupant's head from above and from locations to the sides of lounge chair 106 when an occupant is seated in the lounge chair.

Referring again to FIG. 19, when hood 105 is in the raised position, hood cavity 168 is generally open forward so that the front of the lounge chair is open and a person near the lounge chair is, in effect, welcomed into the space defined by the chair and hood.

Referring again to FIGS. 20 and 21, after a user occupies lounge chair 106, the user can pull the front portion of hood 105 downward into the lowered position so that the user's head is located in a rear portion of cavity 168 adjacent a front surface of headrest subassembly 132. At this point, while the user's head is in cavity 168, most of the space defined by cavity 168 is located in front of the user's face and the cavity is open downward. For this reason, while there is a sense of privacy within cavity 168, the space in front of a user's face and the open bottom end of the cavity substantially mitigate any claustrophobic feelings a user may have within the cavity 168. The slots formed by cap member 166 further mitigating any claustrophobic feelings. Furthermore, in at least some cases hood 105 may be formed of a material that is entirely or at least partially translucent to let some light into cavity 168 which should further mitigate claustrophobic feelings. For instance, in FIG. 15, a strip 269 of hood 105 may be formed using a milky white plastic material that is at least somewhat translucent. As another instance, strip 269 may be at least somewhat transparent when viewed from inside cavity 168 while being reflective or opaque when viewed from outside the cavity. In addition to resulting in a more open feeling, a transparent strip can also allow a lounge occupant to see or sense who is within the vicinity of a lounge chair to gauge a level of privacy within the cavity 168.

Referring yet again to FIGS. 21 and 22, in at least some embodiments a hood assembly 100 may include features that can be use to support a portable electronic device employed by a lounge user to access digital content via a device display. In this regard, exemplary portable devices include smart phones, tablet type computing devices, electronic reader type devices, or any other types of electronic devices that include an electronic display. Consistent with this aspect of the disclosure, at least some embodiments of hood 105 include a device support or docking station 190 disposed on an interior surface of front portion 156 of the hood 105. Docking station 190 is configured to receive and securely hold or support a portable electronic device 192 within the interior 168 of the hood 105. In at least some embodiments, the docking station 190 holds the portable electronic device 156 in a position directly in front of and spaced from lounge headrest 132 when the hood 105 is in the lowered position.

In at least some cases docking station 190 is positioned on the interior surface of hood 105 such that a portable electronic device 192 supported thereby is positioned with a lowermost portion of the device above the lower hood edge 154 so that the device is completely hidden from view at locations outside cavity 168. Fully retaining the portable electronic device 192 within the hood 105 substantially reduces the possibility of audio from the portable electronic device 192 being overheard by people outside of the hood assembly 100 when the device 192 is being used. Further, the generally domed-shaped interior 168 of the hood 105 may, depending on materials used to construct the hood 105, amplify audio generated by the portable electronic device 192 when in use. In other cases docking station 190 may extend below lower edge 154 or may be mounted to edge 154 and extend completely below edge 154.

Figure 35:
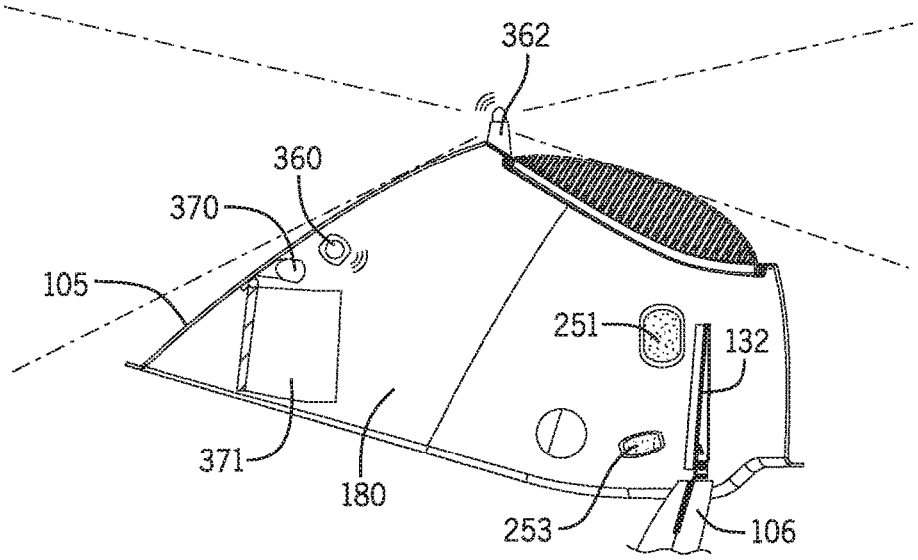
FIG. 35 is similar to FIG. 32, albeit showing various other components within the hood assembly including a permanent display screen, a permanent camera, a motion sensor, a motion indicator, a speaker and a microphone.

Referring again to FIGS. 21 and 22, in addition to the acoustic benefits provided by the interior cavity 168 of hood 105, speakers 194 may be used to enhance audio from a device 192 mounted within hood 105. In the FIGS. 21 and 22 embodiment, a speaker 194 is shown attached to the rear side 176 of headrest 132. In other embodiments it is contemplated that speakers may be attached anywhere within the interior 168 of the hood 105 including to any portion of the interior surface of hood 105 or to bracket 170 or may be built into the headrest 132 to be essentially immediately adjacent the ears of a person occupying lounge chair 106. Exemplary speakers 251 built into hood 105 are shown in FIG. 35. An audio input (see 372 and 373 in FIG. 33) may be provided near docking station 190 to connect device 192 to speakers 194. Wires 196 running along the interior of the sidewall 152 of hood 105 may connect the audio input to speakers 194. In an alternative embodiment, the portable electronic device 192 is connected to the speakers 194 using a Bluetooth or other wireless protocol.

By providing speakers close to a lounge occupant's ears, the volume of sound required from the speakers for the occupant to hear can be reduced appreciably when compared to the volume required from a portable device mounted in the front portion of the hood 105 for an occupant to hear. This is especially true in cases where the speakers can be designed to direct sound toward the locations of an occupant's ears adjacent headrest 132. In effect, the occupant senses sound in a fashion similar to that sensed when the occupant is wearing earphones without requiring the user to wear earphones.

In addition to providing the ability to enhance audio from device 192, speakers may also be used to minimize a lounge occupant's ability to hear sounds from outside cavity 168. For instance, in some cases speakers 194 or 251 may be controlled to generate white noise or some other soothing audible sound (e.g., the sound of a babbling brook, birds chirping, etc.) within cavity 168 to drowned out any ambient noises around the lounge chair 106.

Figure 33:
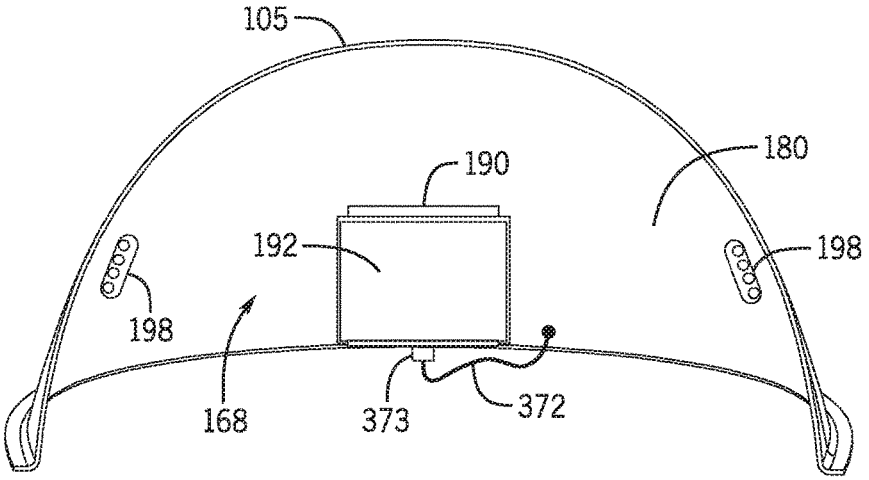
FIG. 33 is a cross-sectional view showing some of the front portion of the hood assembly of FIG. 1.

It has been recognized that a portable device 192 may be used to facilitate several different activities including, among others, independently accessing digital content for work or personal use or to facilitate a telepresence activity whereby a lounge occupant participates in a video conference with one or more remote conferees. Juxtaposition of a device 192 within hood 105 directly in front of a lounge occupant and generally at head height is ideal for both of these types of activities. Referring to FIG. 33, an exemplary mounted portable device 192 is shown within cavity 168.

Figure 32:
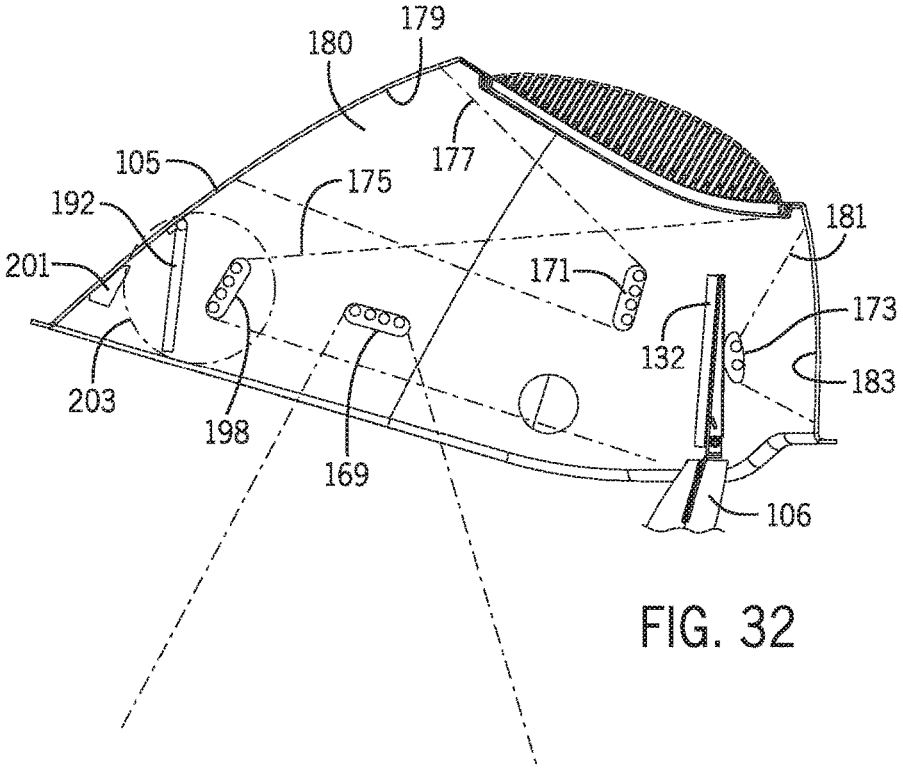
FIG. 32 is similar to FIG. 21, albeit showing a hood assembly including lighting devices and a wireless transceiver mounted therein.

Referring again to FIGS. 21 and 22 and also to FIGS. 32 and 33, at least some embodiments include lights 198, 169, 171 and 173 disposed on an interior surface 180 of hood 105 or at least within cavity 168. The lights may be disposed anywhere within cavity 168 and may be specifically positioned to be optimized for different purposes. For example, some lights 169 may be oriented so light 167 emanates there from downward out of cavity 168 and onto the lap of an occupant in lounge chair 106 to illuminate any reading materials the user may have on her lap or supported on work surface member 141 (see again FIG. 10).

As another example, some lights may be juxtaposed to illuminate the interior of cavity 168 in a way which results in optimized images or video of a lounge occupant for viewing by remote conferees during telepresence activities. To this end, for instance, some of the lights may be located in hood 105 to either directly or indirectly illuminate a lounge occupant's face during telepresence activity. Direct face illumination 175 may be via lights 198 located in the front portion 182A of hood that direct light rearward toward the front surface of headrest subassembly 132 and an upper portion of the lounge backrest. Indirect face/upper torso illumination 177 may be generated via lights 171 that illuminate the front portion 179 of the interior surface of hood 105 or at least portions of the front portion where light reflects rearward toward an occupant's face. Still other lights 173 may be arranged to shine light 181 rearward behind headrest 132 onto the front facing portion 183 of the interior surface of hood 105 to illuminate that surface during telepresence activity. To enhance illumination, the interior surface of hood 105 may have a specific color or may be coated with a luminescent material or paint that appears to glow when light subtends the material or paint. For instance, the interior surface may be painted white or some other light color.

Referring again to FIG. 15, in at least some embodiments hood 105 or portions 269 thereof (e.g., a strip around lower edge 154, a strip about upper edge 150, etc.,) may be formed of a light transparent or translucent material so that when light is shown on an internal surface 180 of hood 105, the transparent or translucent portions 269 pass at least some of the light through to the exterior of hood 105 so that those portions 269 have a glowing appearance from areas outside the hood. Here, when a hood portion is glowing, the glowing portion may serve as an indicator to others outside cavity 168 that the lounge occupant is actively engaged within the lounge in some activity and may operate to encourage others near lounge chair 106 to keep audible disturbances to a minimum.

In at least some cases light controls may be automated so that the lights or different subsets of the lights are automatically controlled based on activities performed by a lounge occupant. For instance, where an occupant does not support a portable device via docking station 190, when the hood is pulled down, lap lights 169 (see again FIG. 32) may be automatically illuminated and an option to manually turn off those lights may be provided. When a device user attaches a portable device to the docking station 190, lap lights 169 may automatically be turned off and dim lights 198, 171, 173 to light up the space within cavity 168 may automatically be turned on. If a lounge occupant commences participation in a telepresence activity, optimized indirect lighting may be automatically turned on and when telepresence activity ceases the indirect lighting may be turned off.

In at least some embodiments wires 196 from the lights 198 run along the interior 180 of the sidewall 152 of the hood 105 along the top end 150 and part way down the interior of the rear portion 158 of the sidewall 152 to a fixed point B. After fixed point B, the wires 196 hang freely and connect to base 102. The freely hanging portion of the wires 196 prevent the wires from interfering with the rotation of the hood 105 between raised and lowered positions. The wires 196 may run within the chair 106 under upholstery covering the shell 110. The wires 196 continue through the pedestal 114 and under the plate 112 within the gap 120. A plug 200 is located at the end of the wires 196 to allow the hood assembly 100 to receive power from a wall or floor receptacle (not shown).

A switch 202 is disposed on a portion of the wires 196 extending from the chair 106. The switch 202 may allow a user to turn on lighting, speakers and other features of the lounge system. Alternatively, the switch 202 may be located within the interior 168 of the hood 105 or on one of the armrests 138A, 138B of the chair 106 to allow the user to power and control the system while seated. In other embodiments, the switch 202 may be removed entirely and a magnetic reed switch (not shown), or other switch may be used to determine when hood 105 is lowered, such that the lights 198 and speakers 194 are turned on when the hood 105 is lowered from the raised position. Additional switches may be provided within hood 105 or on the chair 106 to allow a user to control the brightness of the lights 198 or the volume of the speakers 194.

In FIG. 33, a connector cable 421 is shown in hood 105 adjacent docking station 190 and connected to a portable user's device 192. Light, speaker and other hood component control may be via a processor in device 192 and controls provided via the device 192 display.

Still further, in some embodiments, the speakers 194 and lights 198 may be connected to a wireless system that can be controlled by the user's portable electronic device. To this end, referring again to FIG. 32, when a user's portable device is mounted to the docking station 190 within hood 105, the portable device is located in a clearly defined and relatively small space 203 within the larger cavity space 168. A wireless transceiver 201 may be mounted within cavity 168 adjacent the location 203 of docking station 190 where the transceiver 201 is programmed to obtain device identifying information from a user's portable device 192 when the portable device is mounted to the docking station 190 and to automatically set up a wireless communication link with the device 192. For instance, transceiver 201 may periodically transmit an interrogation signal within a small space adjacent docking station 190 and cause device 192 to transmit an identification signal when mounted to docking station 190. Once a unique device is identified as being mounted to docking station 190, device 192 may be programmed to drive speakers 194 within cavity 168 instead of generating output using speakers that form part of device 192 itself.

Similarly, referring to FIG. 35, in some embodiments one or more microphones 253 may be mounted to the internal surface of hood 105 that can be linked wirelessly (or in a wired fashion) to a user device 192 so that device 192 uses the hood mounted microphone instead of a microphone built into device 192. The microphones may be used to obtain relatively higher quality sound from a lounge occupant during a telepresence activity. In addition, because the microphones can be placed closer to a lounge occupant's mouth, the occupant may be able to speak in a lower volume and still generate voice at a suitable level for telepresence activity thereby further minimizing the possibility that a person outside cavity 168 will hear a lounge chair occupant's portion of a conversation.

As seen in FIG. 22, a rechargeable battery 191 may also be provided as part of the assembly 100 for powering assembly lights, speakers, microphones, etc. In FIG. 22 the battery is built into an undersurface of shell 110 but the battery could be supported at any other location on assembly 100.

Referring now to FIGS. 23A-E, a first embodiment of the docking station 190 is illustrated. Exemplary support 192 generally includes a base 210, a jaw subassembly 212 and a sliding hinge assembly 214. Exemplary base 210 includes a rectangular frame structure that forms first and second parallel and facing tracks or elongated recesses 222 in facing surfaces of lateral frame members. The base 210 may include screw holes or other features that enable mechanical fastening of base 210 to the interior surface of hood 105 as shown in FIGS. 21 and 22. Hinge 214 includes a shoulder member and pins (see exemplary pins 234 in a second embodiment shown in FIG. 24A) that extend from opposite ends and that are designed to be received within tracks 222 for sliding motion there along. The fit between the pins and the tracks 222 may be a friction fit so that as hinge 214 moves along the tracks, the hinge maintains whatever position the hinge is place in along the lengths of the tracks.

Jaw subassembly 212 includes a first jaw member 216A and a second jaw members 216B as well as spring subassemblies 220. Each of the first and second jaw members is a rigid elongated member and forms a channel 218A and 218B for receiving an edge of a portable electronic device 192. First jaw member 216A is hingedly mounted to hinge 214 for rotating about a generally horizontal axis (see different positions of first jaw 216A in FIGS. 23A and 23B). Spring subassemblies 220 link jaws 216A and 216B together with channels 218A and 218B facing each other and biases second channel 218B toward first channel 218A. The spring bias can be overcome by applying a separating force to pull second jaw 218B away from first jaw 218A as shown in FIG. 23D. The springs 220 are selected such that the spring force is substantially greater than a gravitational force associated with the heaviest portable device 192 intended to be used with the docking station 190 so that the jaws not only support a portable device mounted to the docking station 190 but also grip and retain the device after reception between the channels and release of the lower jaw member 216B. In at least some embodiments channels 218A and 218B may be covered with rubber or some other tacky material to prohibit sliding of a device 192 out of the space defined by channels 218A and 218B after installation.

Figure 23C:
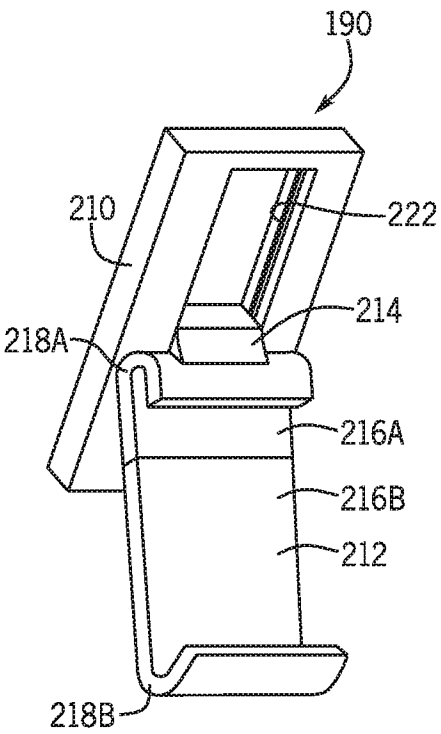
FIGS. 23A-D are diagrammatic views of a first embodiment of a dock station shown in various stages of use.
Figure 23B:
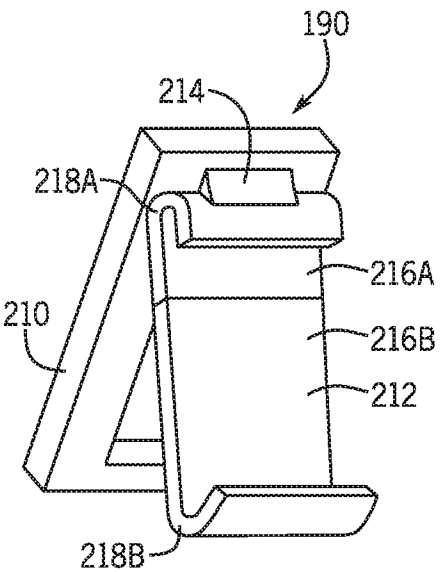
Figure 23A:
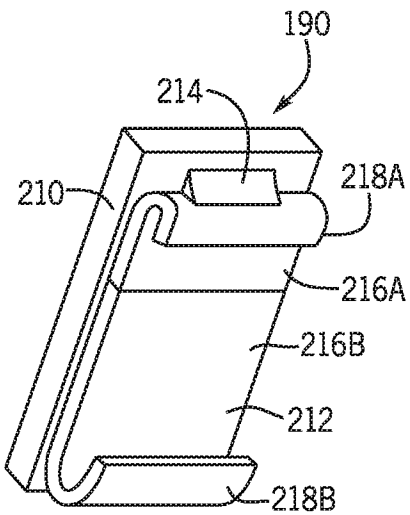
Figure 23E:
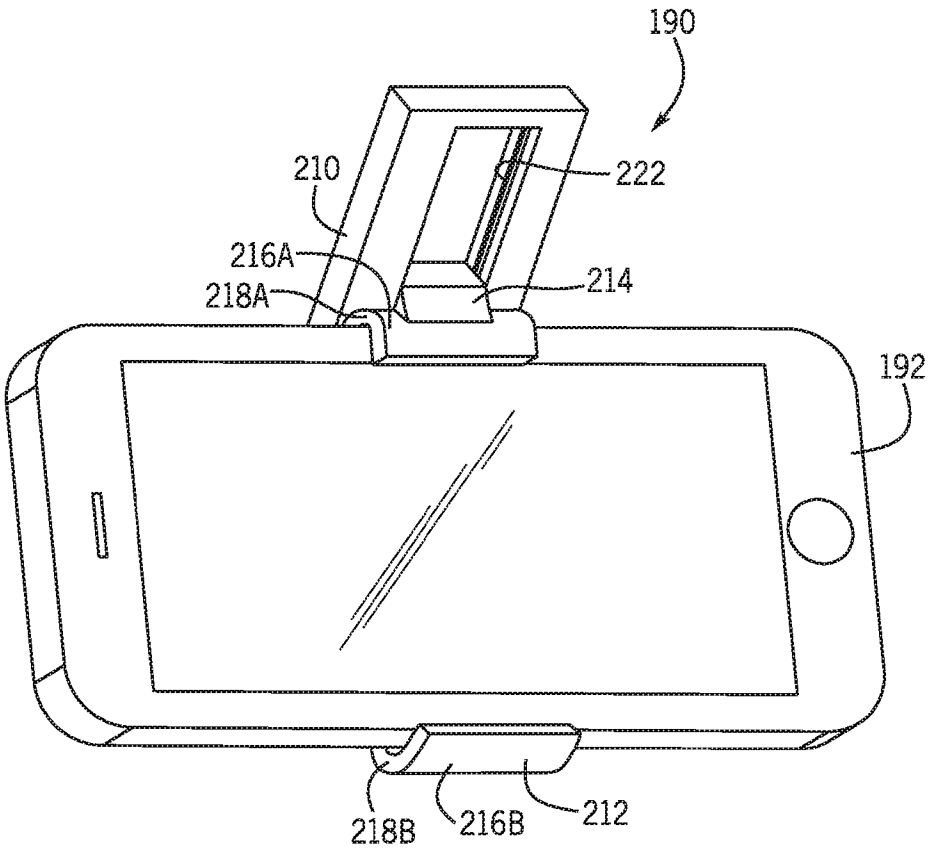
FIG. 23 E is a diagrammatic view of the dock station of FIGS. 23A-D shown housing a portable electronic device.
Figure 23D:
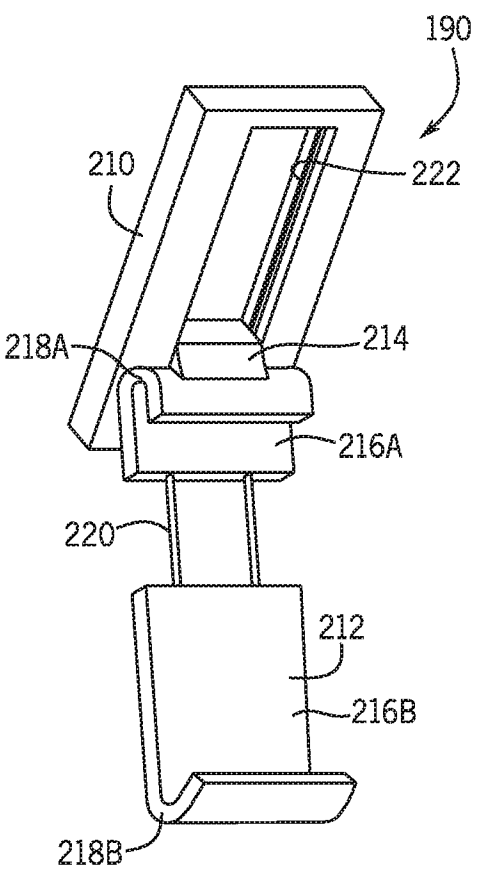

Referring to FIGS. 2, 21 and 23A through 23E, to mount a device to docking station 190, a person occupying lounge chair 106 may rotate the lower end of jaw subassembly 212 toward the user as shown in FIG. 23B. Next, jaw subassembly 212 and hinge 214 may be slid downward as in FIG. 23C and then lower jaw 216B may be pulled downward as in FIG. 23D. A user's portable device 192 may be placed within the space between channels 218A and 218B and lower jaw 216B may be released so that the force of springs 220 cause the lower jaw to clamp device 192 I place as in FIG. 23E. At this point the lounge occupant can adjust the angle of device 192 via hinge 214 or the height of device 192 via sliding of hinge 214 within tracks 222 until an optimal height and angle result. The rotating and sliding motion of the sliding hinge 214 allows the jaw 212 to be adjusted in three dimensions, which allows a user to adjust the location of the portable electronic device 192 to obtain the best viewing angle and to be at an optimal viewing height.

Referring still to FIGS. 23A through 23E, another process to mount a portable device to station 190 is to use an edge of the portable device as a tool to separate lower jaw 216B from upper jaw 216A. Advantageously, this process can be performed by a lounge occupant using one hand so the occupant can control other items (e.g., a coffee cup, papers, etc.) within the lounge space during the mounting process. Here, with a lower edge of a portable device in channel 218B, the assembly 190 components can be moved through the juxtapositions shown in FIGS. 23A through 23D until the portable device is between jaws 216A and 216B at which point, as the portable device is raised, the springs 220 cause lower jaw 216B to clamp the portable device as shown in FIG. 23E.

In at least some embodiments station 190 springs 220 will be dimensioned such that station 190 will be able to accommodate portable devices in either landscape or portrait orientations. This will be advantageous in at least some cases as portrait orientation is usually optimal for telepresence activity while landscape orientation is preferred for viewing other types of digital content (e.g., media).

Figure 24B:
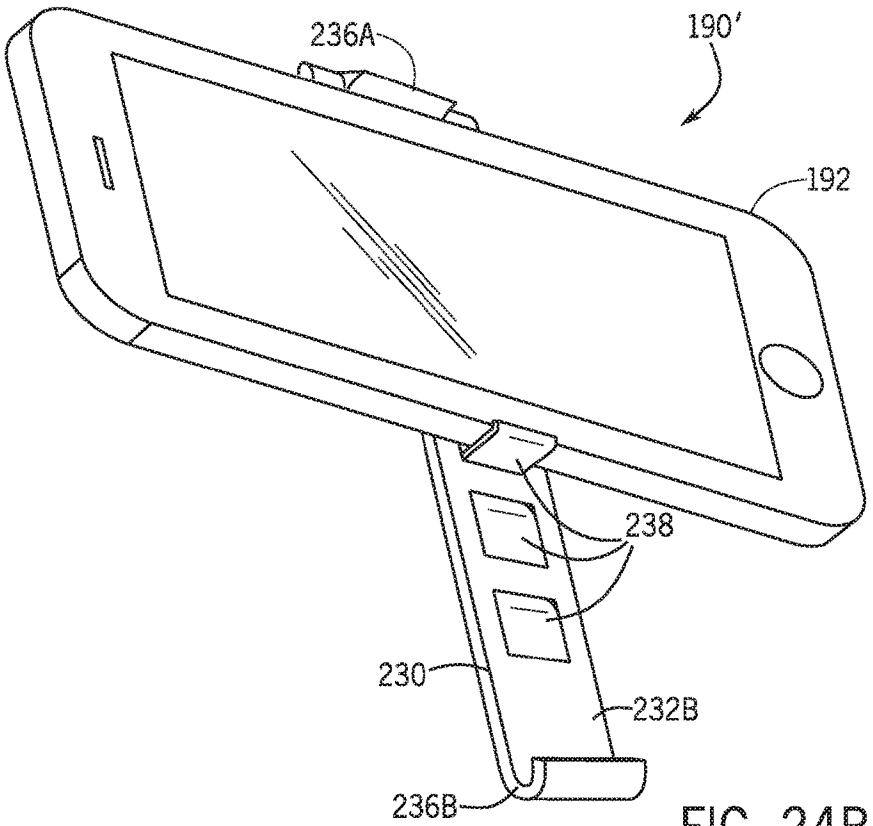
FIG. 24B is a diagrammatic view of the dock station of FIG. 24A shown holding a portable electronic device.
Figure 24A:
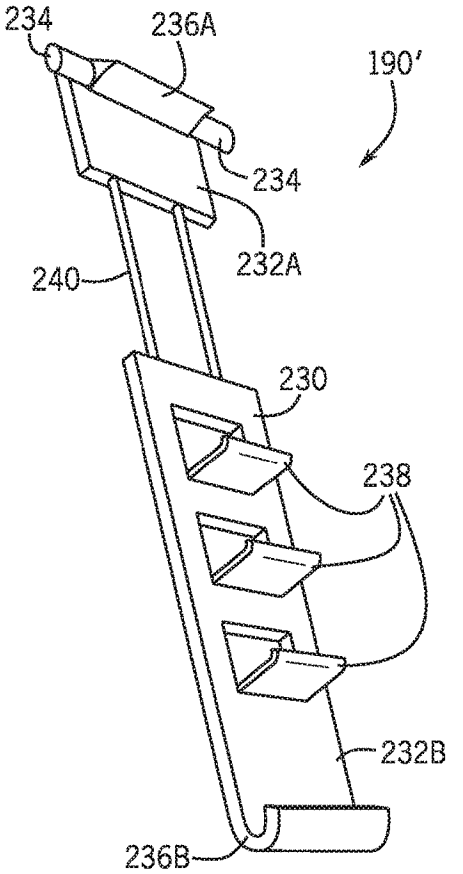
FIG. 24A is a diagrammatic view of another embodiment of a dock station.

Turning to FIGS. 24A and 24BB, an embodiment of an alternative docking station 190' is shown that includes a jaw 230 having upper and lower portions 232A, 232B. The upper portion 232A includes pins 234, which are rotatably attached to the interior of the hood 105 and a shelf 236A. The lower portion 232B includes a bottom shelf 236B and a plurality of flip out shelves 238. The flip out shelves 238 are rotatably connected to the lower portion 232B of the jaw 230 and can rotate between open positions (see FIG. 24A) and closed positions (see FIG. 24B). In the present embodiment the docking station 190' includes three flip out shelves 238, however it is contemplated that any number of flip out shelves 238 may be used. The upper and lower portions 232A, 232B are connected by a spring mechanism 240 similar to that described above. In use, a force is applied to the jaw 230 to separate upper and lower portions 232A, 232B. The portable electronic device 192 is thereafter inserted within the jaw XX and the force is removed, which allows spring mechanism 240 to pull the jaw 230 closed. Tension from the spring mechanism 240 allows the shelves 236A, 236B to close around the device thereby retaining the device 192 within the jaw 230. Alternatively, if a different sized portable electronic device 192 is used one of the flip out shelves 238 may be opened to accommodate a different size device.

Figure 25:
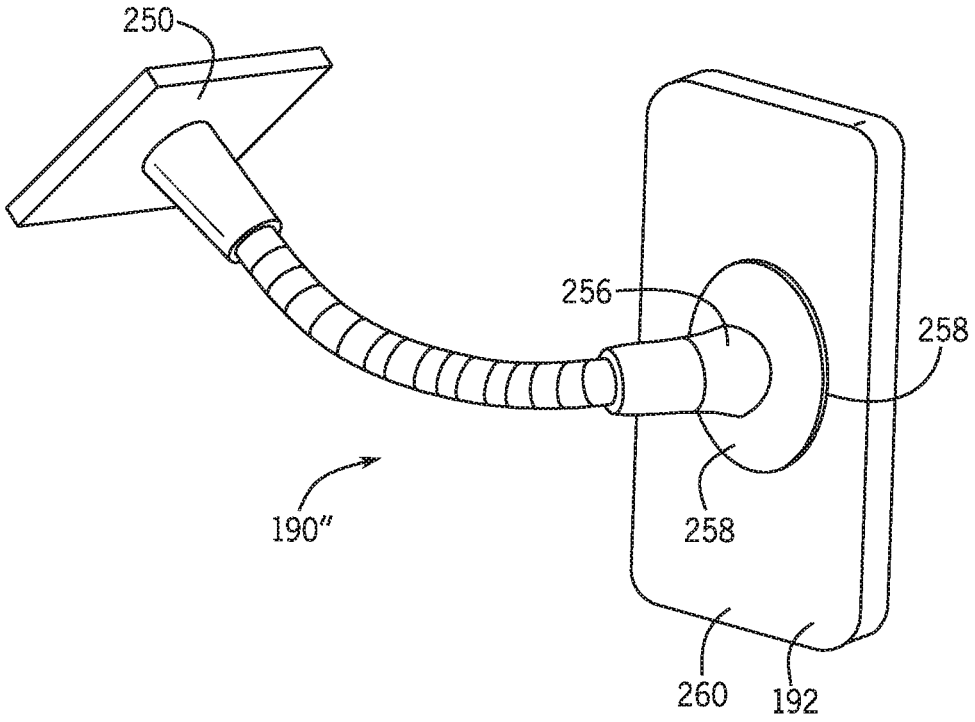
FIG. 25 is a diagrammatic view of yet another embodiment of a dock station shown holding a portable electronic device.

A further embodiment of a docking station 190" is shown in FIG. 25. Docking station 190" includes a base 250 for attaching the support to the interior 180 of the hood 105 either via an adhesive or via some mechanical fastening mechanism (e.g., screws, Velcro, etc. A flexible neck 252 extends from the base to a mounting cup 254 located on a distal end 256 thereof. The mounting cup 254 includes a suction cup 258, which can be attached to a rear side of a portable electronic device 192 thereby supporting the device 192. The flexible neck 252 allows a user to adjust the position of the portable electronic device 192 during use to obtain an optimal viewing angle.

Figure 26:
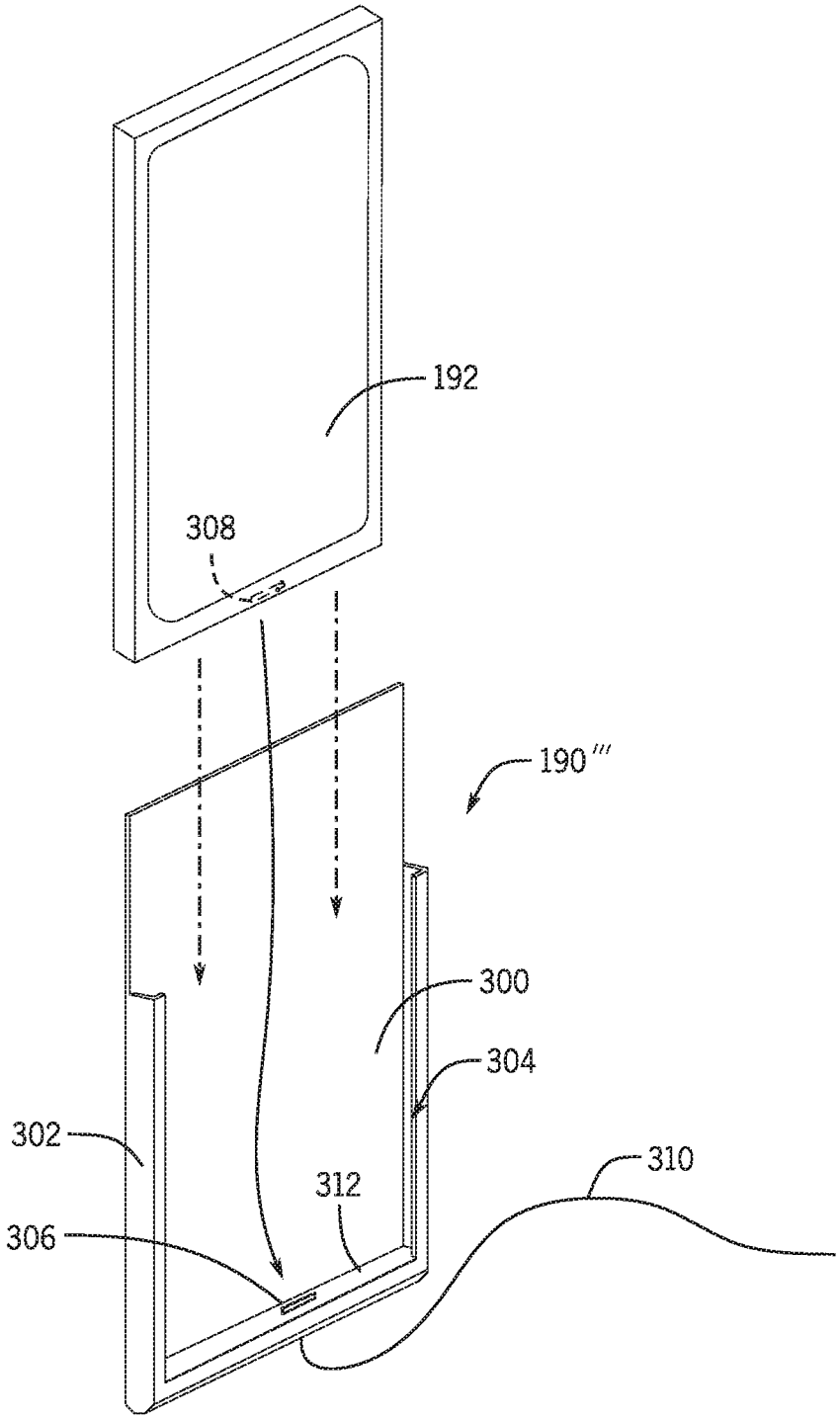
FIG. 26 is a diagrammatic view of another embodiment of a docking station shown with a portable device being docked.

Referring to FIG. 26, another embodiment of a docking station 190''' is shown that includes a mounting member 300, first and second lateral lip members 302 and a floor member 312. Mounting member 300 is a rectangular rigid member that has a rear surface and an oppositely facing front surface. Although not shown, member 300 may include mounting apertures or other structure to facilitate mounting of docking station 190''' to the internal surface of hood 105. Lip members 302 extend outwardly from the front face of member 300 and form facing parallel channels 304 that have a width dimension similar to the width of a standard portable device.

In at least some embodiments a resilient layer of flexible material may be provided in each channel 304 that can temporarily be crushed so that devices 192 of different thicknesses within a general range can be accommodated. Floor member 312 extends along a bottom edge of member 300 and traverses the distance between lower ends of lip members 302. A width dimension between lip members 302 is similar to a width dimension of a portable device 192 to be received therein. Although not shown, in some cases one or both of lip members 302 may be laterally adjustable on slides or the like so that docking station 190''' can be adjusted to accommodate devices 192 having different width dimensions. Device 192 can be slid into docking station 190''' so that lateral edges of device 192 are received in channels 304.

Referring again to FIGS. 1 through 10 and FIG. 21, it should be appreciated that when a person occupies lounge chair 106 and mounts a portable electronic device 192 to docking station 190 so that a display of device 192 and a camera of device 192 both face the occupant, the juxtaposition of the device display and a device camera with respect to the occupant is generally ideal for telepresence activities. It should also be appreciated that because the juxtapositions of the user and the portable device mounted to the hood are fixed after mounting and while the hood remains in the lowered position, even if the occupant of the lounge chair rotates the chair on pedestal 114, the frame of reference associated with the field of view of the camera will remain on the occupant and the portion of the hood behind the occupant's head and therefore the rotation will not distract remote conferees. This is important as even partial rotation of a lounge can increase privacy or at least create a sense of increased privacy. For instance, a lounge chair 106 may be located near a wall and initially face away from the wall. After a user occupies the lounge chair, moves the hood to the lower position and mounts a portable device to docking station 190, a simple rotation of the lounge through 180 degrees so the lounge faces the wall will cause the occupant's voice to be directed toward the wall instead of toward the open space now behind the lounge chair 106. Other rotations based on locations of other adjacent people will have the same effect on the occupant's feeling of privacy.

Figure 27B:
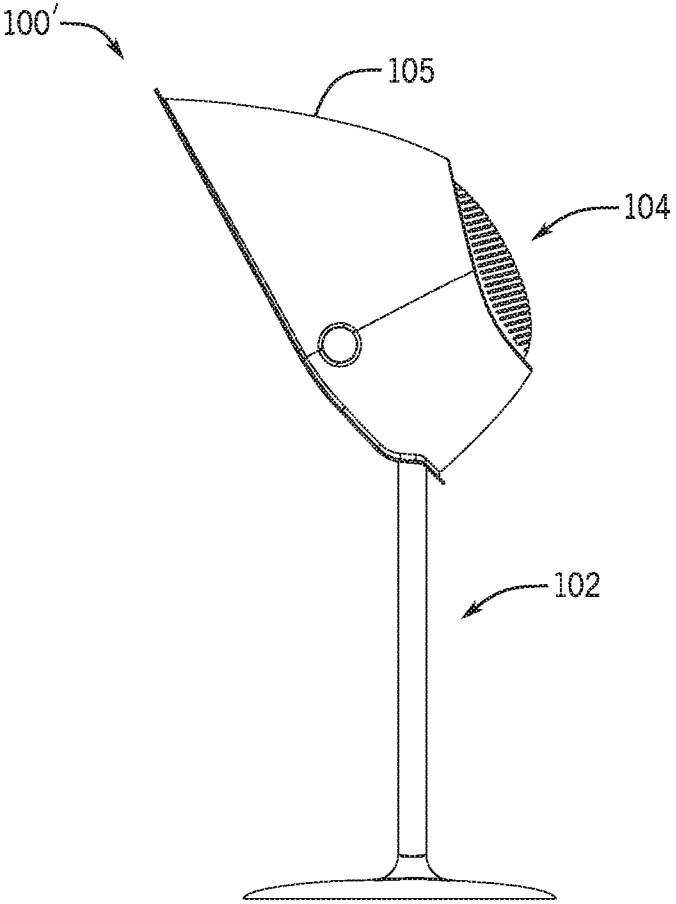
FIG. 27B is a left side elevational view of the hood assembly of FIG. 27A, wherein the hood is shown in the raised position.
Figure 27A:
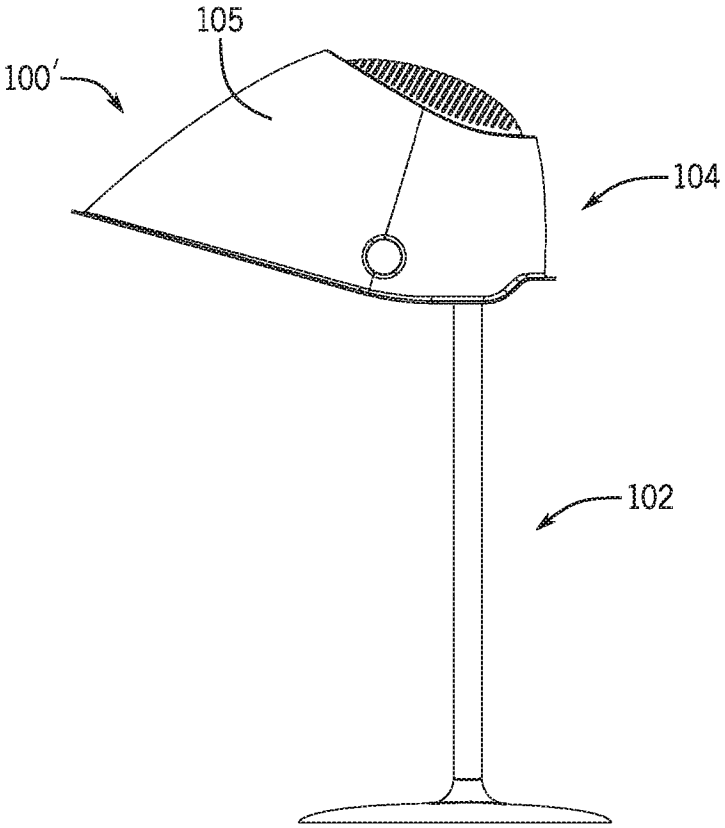
FIG. 27A is a left side elevational view of another embodiment of a hood assembly, wherein a hood is shown in a lowered position.

In alternative embodiments of the hood assembly 100, it is contemplated that the hood 105 may be used with a different base 102. For instance, the hood may be used with a lounge chair having a design that is different than the design described above. As another instance see FIGS. 27A and 27B where an exemplary hood 105 is rotatably attached to a pole 270 thereby allowing a user to stand while using the hood assembly 100' or to sit within a lounge chair (not illustrated) that is separate from assembly 100'. The pole 270 may be adjustable to allow users of various heights to comfortably use the hood assembly 100'. The hood assembly 100' may include any combination of the docking station 190, 190', 190" and 190''' described above or any portable electronic device supports known to one skilled in the art.

Figure 28:
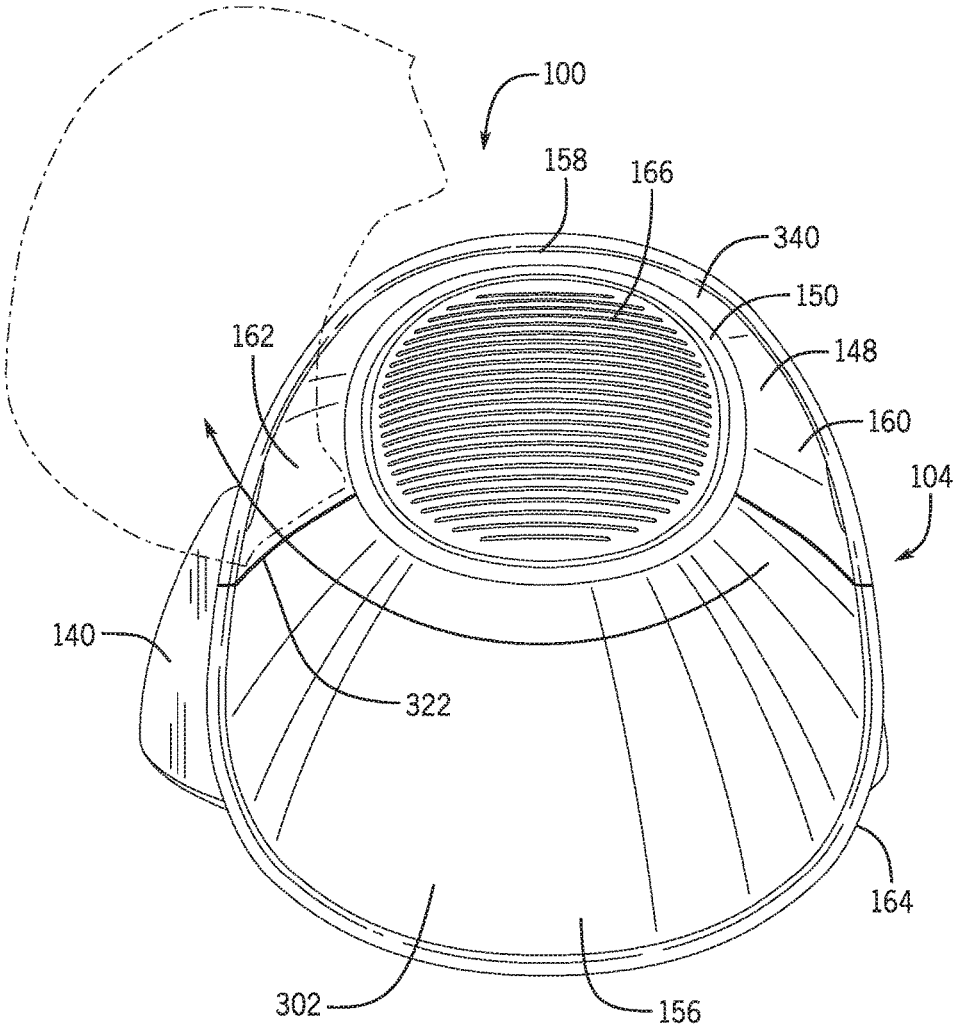
FIG. 28 is similar to FIG. 5, albeit showing a hood including a front portion hingedly connected to a rear portion.

In still other embodiments it is contemplates that the hood 105 may open up in a different fashion to enable a lounge occupant to enter and exit the lounge chair assembly. For instance, see FIG. 28 where the hood 105 includes a front portion 320 and a rear portion 340 where the front portion 320 is hinged at hinges 322 to one edge of the rear portion 340. In this case, the front portion 320 may be rotated about hinges 322 to the position shown in phantom to allow a user to occupy or leave the assembly. Once in the lounge chair, an occupant may rotate the front portion 320 to a closed position for semi-private activities. In this case the hood 105 would be mounted to distal ends 178 of brackets in a stationary fashion as rotation about the horizontal axis would not be required. Other configurations with other generally vertical or horizontal hinge lines are contemplated. In still other embodiments, referring again to FIG. 21, instead of having hood 105 rotate about distal end 178, a horizontal pivot or hinge may be provided at the location of shoulder member 172.

Figure 29:
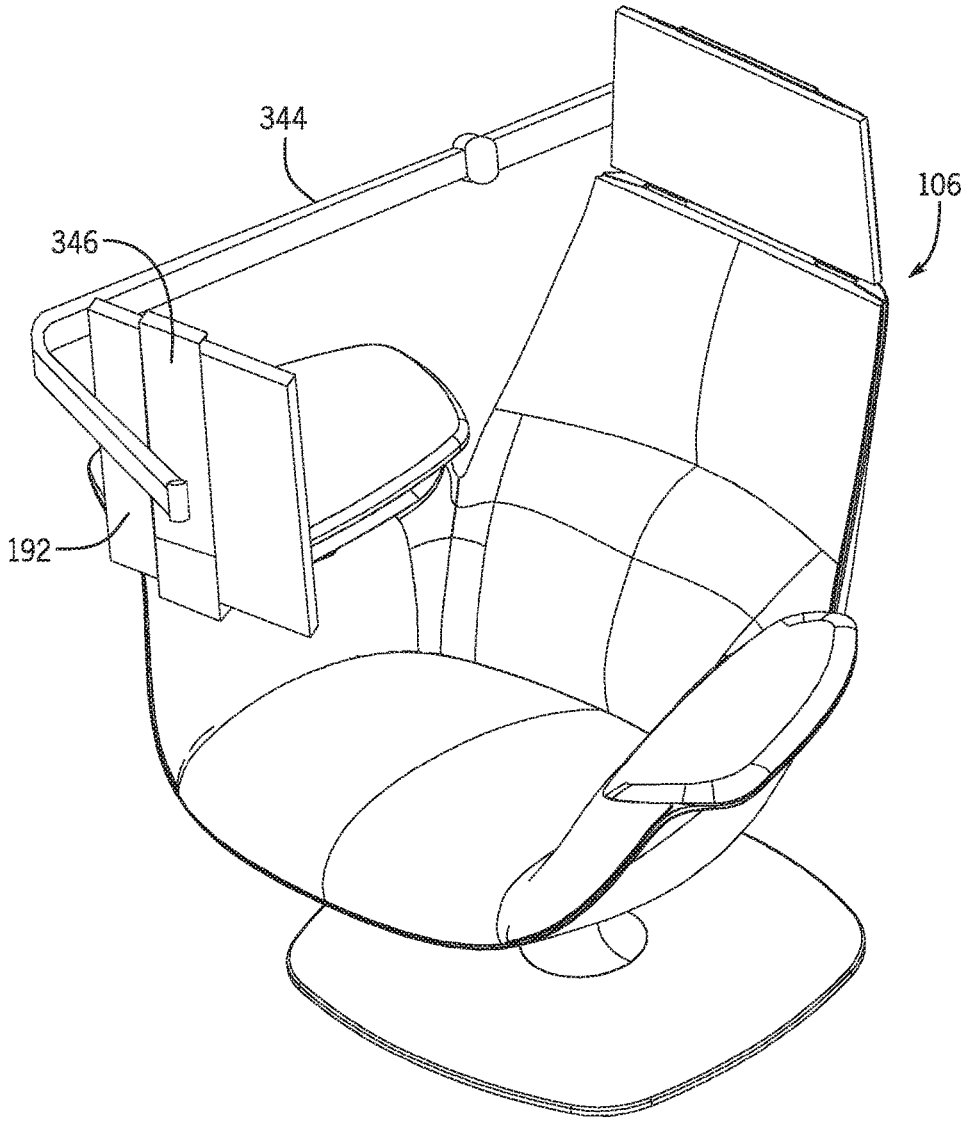
FIG. 29 is similar to FIG. 1, albeit showing an exemplary device support arm instead of a hood assembly mounted to a lounge chair.
Figure 30:
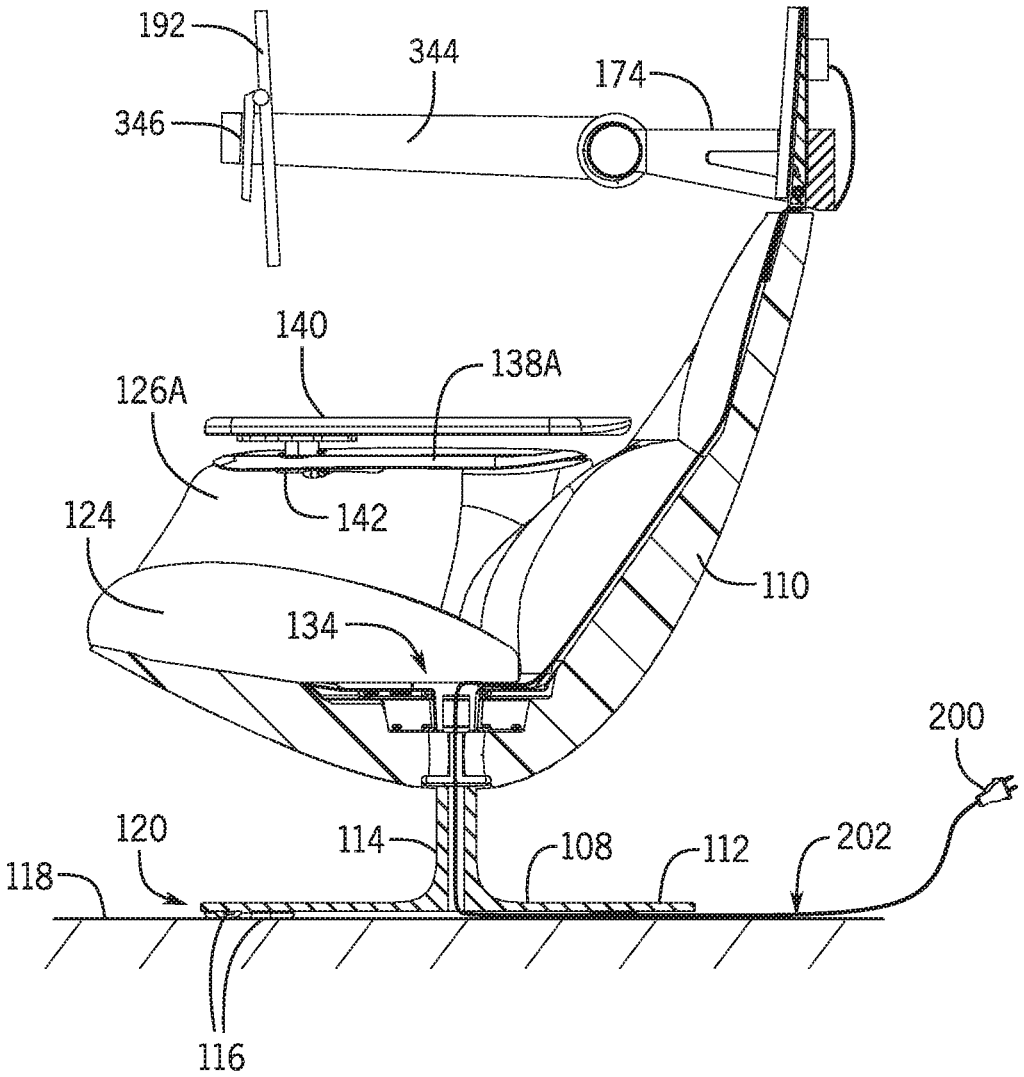
FIG. 30 shows the assembly of FIG. 29 in cross-section.
Figure 31:
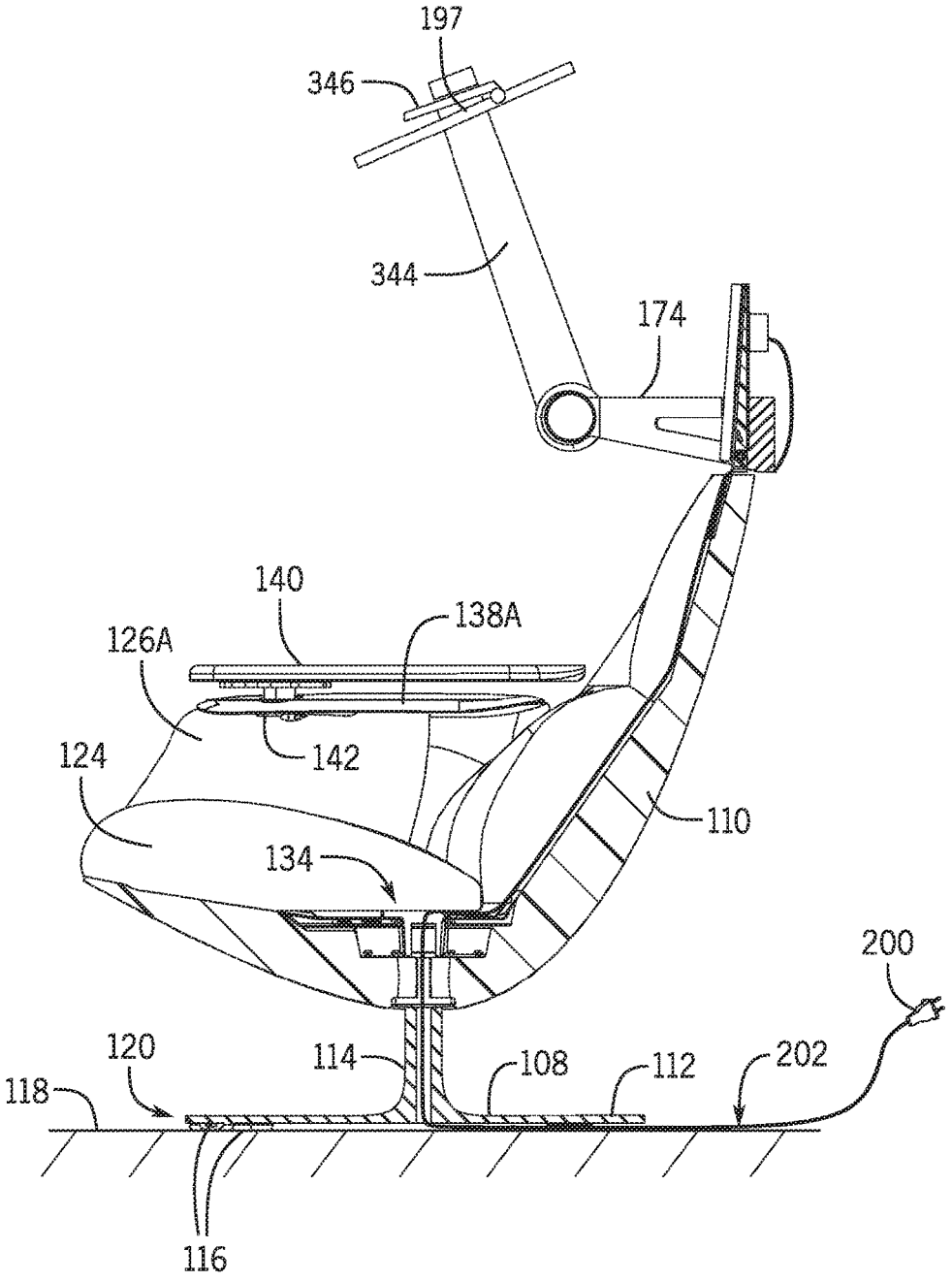
FIG. 31 shows the assembly of FIG. 29 in cross-section with a support arm in a raised position.

In other embodiments a support structure or arm may be provided instead of a hood assembly for supporting a portable device. To this end, see FIGS. 29 through 31 that show a pivoting support arm 344 mounted to the distal end of arm member 174 and a docking station 346 mounted at the distal end of the pivoting support arm 344. Here, arm 344 can rotate about a horizontal axis at the juncture between arm members 174 and 344 to move arm 344 and device 192 supported thereby from a viewing position as in FIG. 30 to a raised position as in FIG. 31 to allow user access to the lounge space.

Figure 36:
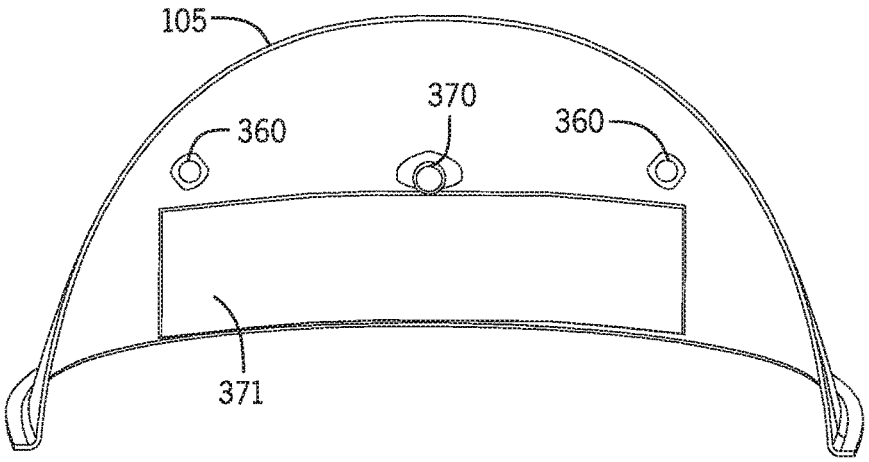
FIG. 36 is similar to FIG. 33, albeit showing the components of FIG. 35.

In still other embodiments, referring to FIGS. 35 and 36, a display screen 371 may be permanently mounted to the internal surface of hood 105 within cavity 168 for use by a lounge user. Here, referring also to FIG. 37, a linkage or connecting cable 372 for connection to a user's portable device 192 may be provided within armrest recess 144 so that content from the user's device or obtained wirelessly by the user's device from a remote server or the like can be used to drive the permanent display 371. Because the display may be more permanent in this case, a larger display or a curved display may be supported within the hood 105 to provide a better experience for a lounge user.

In FIG. 37, instead of providing a wired cable 372 to connect to a users device, a wireless connection may be provided via a wireless transceiver 277 akin to wireless transceiver 201 described in reference to FIG. 32. Here, transceiver 277 may have a sensing field 279 restricted to the space of cavity 144 so linkage is only established for a portable device within cavity 144. In other embodiments a sensing field may comprise a column of space including hood cavity 168 and space there below so any device 168 located within the column is automatically linked to the system for driving permanent display screen 371, speakers and lights and for receiving sound from hood microphones.

Referring still to FIGS. 35 and 36, where display 371 is permanent, a permanent camera 370 may also be provided either within the display bezel or mounted to the top of the display or otherwise mounted to an internal surface of hood 105 where the camera is optimized for telepresence activity within the hood environment. Here, again, if a user's portable device is linked via a cable 372 within the armrest recess 144 (see again FIG. 37), the user's device may be able to facilitate wireless telepresence activity where video, sound and lighting in cavity 168 are all provided via hood hardware and may be driven by the application on the user's device. Here, because the application would be on the user's device, each user could optimize the application on their device by setting operating parameters in a customized fashion that the application would automatically implement upon the user linking to the cable 372.

In still other embodiments a user's portable device linked via cable 372 or otherwise (e.g., wirelessly) to the lounge assembly may be usable as a control interface for content presented on a permanent screen of device 371. This capability would eliminate the need for a lounge occupant to reach up and interact with device 192 via touch which could become cumbersome.

While a processor in a portable device (e.g., 192) may be used to control hood and lounge chair components such as lighting, speakers, microphones, etc., in other embodiments, a processor may be provided in hood 105 or in a base such as lounge chair 106, where the processor communicates with a user's portable device and handles at least a portion of the control activities. To this end, see FIG. 34, where a hood processor 400 is linked to various components including a portable device connector 373, a hood camera 370, hood microphone(s) 253, lights 198, 169, 171 and 173, speakers 251 and a wireless transceiver 201.

Figure 34:
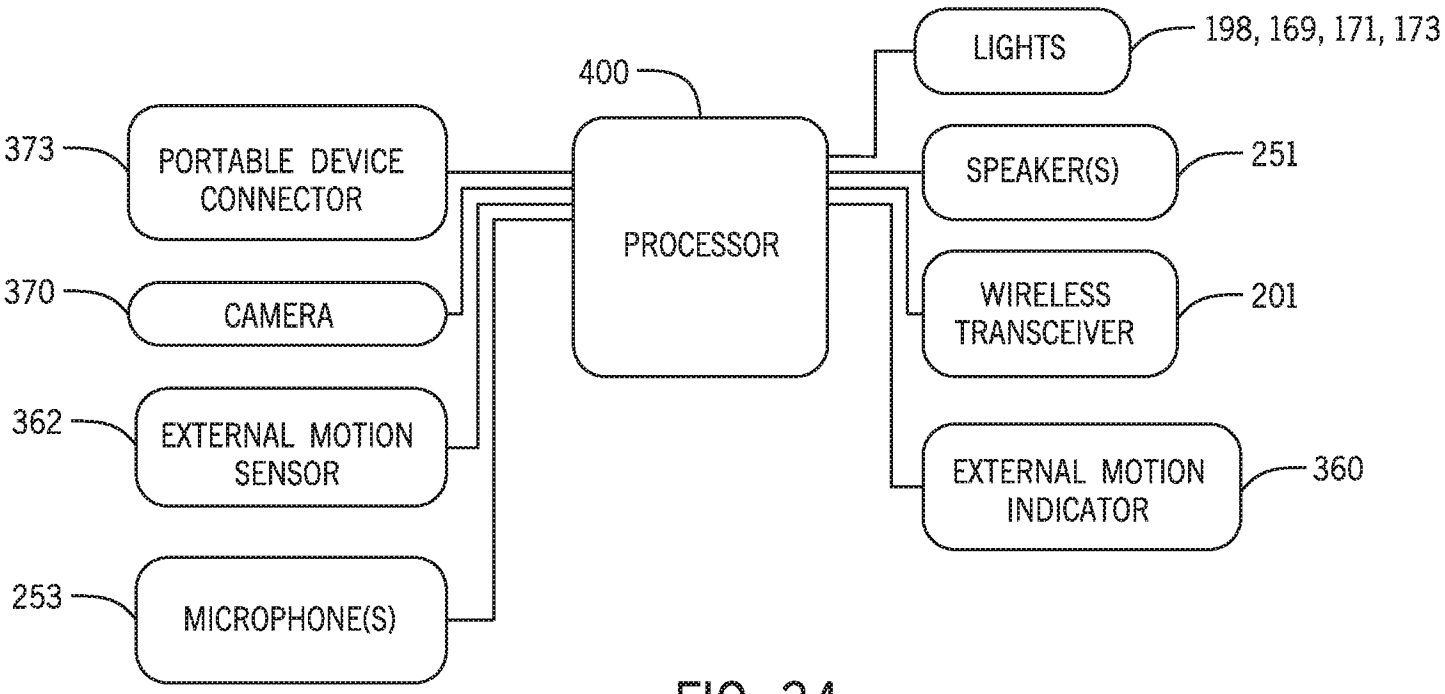
FIG. 34 is a schematic illustrating various components that may be included in the hood or the lounge assembly of FIG. 1.

In still other embodiments it is contemplated that a sensor and indicator combination may be provided to sense when another person is located proximate lounge chair 106 and provide an indication within hood 105 for a lounge occupant therein. To this end, see again FIG. 35 where an optical sensor 362 is located on the top of hood 105 for sensing any movement within a space proximate the hood 105. Here, for instance, the sensor 362 may sense movement within 10 feet of the hood, within 5 feet, etc. When movement is sensed, sensor 362 may generate a signal to drive an indicator 360 mounted on the interior surface 180 of hood 105 at a location that should be easily viewable by a lounge occupant. For instance, when no one is sensed proximate hood 105, indicator 360 may not be illuminated. Once a person is sensed within the proximate area of hood 105, indicator 360 may indicate by flashing a red LED on and off. FIG. 34 shows sensor 362 and indicator 360 linked to hood processor 400. Other indications such as an audible signal via a speaker or the like are contemplated.

Figure 38:
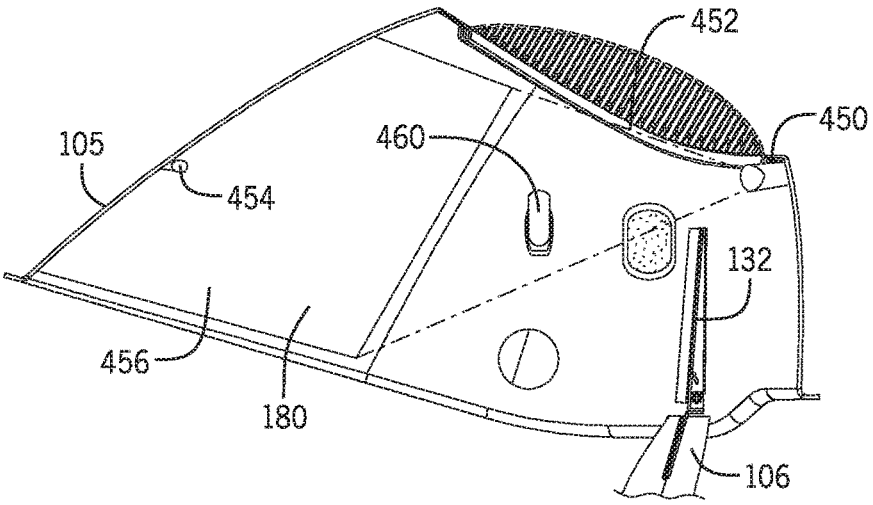
FIG. 38 is similar to FIG. 33, albeit showing additional components in the hood including a projector and a digital scent generating device.

Referring to FIG. 38, in still other embodiments it is contemplated that a projector 450 may be mounted within hood 105 for projecting images/video, etc., onto at least a portion of the interior surface 180 of the hood for facilitating digital content, viewing, telepresence activity, etc. Here, in at least some cases, the portion of interior surface 180 projected upon may be colored and/or textured to reflect projected light well so the quality of the image is enhanced. The projected images may be corrected to compensate for curvature of the surface projected on to so that from the perspective of a lounge occupant's eyes, the images appear without distortion. In FIG. 38 the projected field of view is labeled 452 and the portion of the interior surface projected upon is labeled 456. A small camera 454 is shown mounted to surface 180 and directed rearward toward the location of a lounge occupant for facilitating telepresence activity.

In FIG. 38, projector 450 and camera 454 may be permanently secured to hood 105 and may be controlled by a user's portable device linked to the hood/lounge assembly either wirelessly (e.g., see wireless transceiver 277 in FIG. 37) or via a cable connection (see 372 in FIG. 277).

In some cases it is contemplated that a scent component may be added to a hood 105 for generating a scent generally within the hood cavity 168 and perhaps with a column of space there below. To this end, see again FIG. 30 that shows a hood scent device 460 mounted to internal surface 180. Device 460 may include a pocket for receiving a scented chemical packet (e.g., an air freshener). In other cases, device 460 may include a digital scent synthesizer. For instance, a company DigiScents in Oakland, Calif. has developed a digital scent device that can be powered using a standard electrical outlet. DigiScents has indexed thousands of smells based on chemical structure. Each scent is coded and digitized into a small file which can be embedded into a digital packet for remote transmission. A user can select any desired scent and receive a defining digital packet used by the scent device to produce the scent. The scent device includes a cartridge that contains 128 primary odors that can be mixed together to create any of the coded scents. Again, a user's portable device may be used to link to an control the scent device either wirelessly or in a tethered fashion.

In embodiments where a lounge occupant's portable device drives a display, a projector, lights, or speakers built in to a hood 105 or receives input from a microphone or other device associated with a hood 105, it is contemplated that a hood control application will be provided that can be downloaded to the occupant's device once and that can be used thereafter with any hood assembly.

While various lounge and hood dimensions may be configured, empirical evidence has shown that some optimal dimensions and dimension ranges may be used. For instance, a height of the top surface of a lounge seat may be anywhere within a range of 300 to 500 mm above a supporting floor and more optimally between 350 and 450 mm with a still more optimal range between 390 and 410 mm, a floor to top of head rest dimension may be between 850 and 1250 mm with a more optimal range of between 950 and 1150 mm and a still more optimal range of between 1040 and 1080 mm, an optimal range of width between side arm members may be between 480 and 520 mm, a depth of cavity 168 between a ceiling surface of the cavity and a lower edge may be within the range of 320 and 440 mm with a more optimal range between 370 and 400 mm, an optimum width of the hood 105 at the mounting locations may be within the range of 700 and 860 mm with a more optimal range between 740 and 820 mm and a still more optimal range between 760 and 800 mm, a length of the hood 105 between front and rear edges may be within a range of 700 and 1300 mm and more optimally may be within a range of 900 and 1100 mm and may be more optimally within a range between 1000 and 1050 mm, and a height dimension between a lower edge of the hood 105 and a top surface of the lounge seat when the hood is in a lowered position may be within a range of 200 and 500 mm and more optimally within a range of 300 and 400 mm and still more optimally within a range between 350 and 380 mm.

The hood assembly described herein advantageously provides a low cost and accessible place for a user to privately use her portable electronic devices. Further, the hood assembly supports the portable electronic device thereby allowing the user to comfortably view her device.

Numerous modifications will be apparent to those skilled in the art in view of the foregoing description. Accordingly, this description is to be construed as illustrative only and is presented for the purpose of enabling those skilled in the art to make and use what is herein disclosed and to teach the best mode of carrying out same. The exclusive rights to all modifications which come within the scope of this disclosure are reserved.

We claim:

1. A hood assembly for supporting a portable electronic device having a display screen in a viewable position, the assembly comprising:

a hood including a wall structure, at least a portion of the wall structure being light transmissive, the wall structure including an internal surface that forms a substantially downwardly opening cavity, the cavity including a front portion and a rear portion, the cavity opening circumscribed by a lower edge that has a front edge portion adjacent the front portion of the cavity, wherein the hood is configured to be coupled to a base;

a support device supported within the hood and adjacent the front edge portion, the support device configured to receive and support the portable electronic device with the device display screen disposed at an oblique angle to the internal surface such that the display screen is facing and in a line of sight of a user within the hood and blocked from a line of sight from outside of the hood when the hood is in a viewing position; and a wireless communications device provided in at least one of the hood and the base, and wherein the wireless communications device is configured to communicate with the portable electronic device, the wireless communications device having a sensing field including the space of the cavity.

2. The hood assembly of claim 1, wherein the portion of the wall structure that is light transmissive is a slotted structure.

3. The hood assembly of claim 2, wherein the slotted structure comprises a ceiling cap portion.

4. The hood assembly of claim 1, wherein the portion of the wall structure that is light transmissive comprises a material that is at least partially translucent.

5. The hood assembly of claim 1, wherein the portion of the wall structure that is light transmissive comprises a material that is at least partially transparent.

6. The hood assembly of claim 1, wherein the portion of the wall structure that is light transmissive is a mesh material.

7. The hood assembly of claim 1, wherein the wall structure comprises a skeletal frame, and one or more layers of a material stretched across the frame.

8. The hood assembly of claim 7, wherein the one or more layers of a material comprise at least one of a sight blocking material and a sound deadening material.

9. The hood assembly of claim 1, further comprising at least one of an input device and an output device, wherein the at least one of an input device and an output device includes at least one light device mounted to the hood for illuminating at least a portion of the space within the cavity.

10. The assembly of claim 9, wherein the portion of the wall structure that is light transmissive comprises a transparent or translucent portion, and wherein the light device illuminates the transparent or translucent portion when active.

11. A hood assembly for supporting a portable electronic device having a display screen in a viewable position, the assembly comprising:

a hood coupled to a base, the hood including a wall structure that includes an internal surface that forms a substantially downwardly opening cavity, the cavity including a front portion and a rear portion, the cavity opening circumscribed by a lower edge that has a front edge portion adjacent the front portion of the cavity; and a support device supported within the hood and adjacent the front edge portion, the support device configured to receive and support the portable electronic device with the device display screen disposed at an oblique angle to the internal surface such that the display screen is facing and in a line of sight of a user within the hood and blocked from a line of sight from outside of the hood when the hood is in a viewing position; and a wireless communications device provided in at least one of the hood and the base, and wherein the wireless communications device is configured to communicate with the portable electronic device within the cavity.

12. The assembly of claim 11, further comprising a processor provided in at least one of the hood and the base, the processor in communication with the communications device.

13. The assembly of claim 12, wherein the processor comprises the communications device.

14. The assembly of claim 12, wherein the processor is programmed to control at least one of a light, a speaker, and a microphone in the hood.

15. The assembly of claim 12, wherein the processor is adapted to enable download of a hood control application to a portable user device.

16. The assembly of claim 11, further comprising a display mounted within an internal cavity of the hood, and wherein a portable user device is in communication with the display to drive the display.

17. The assembly of claim 12, further comprising a plurality of lights supported within a space defined by the hood, and wherein the lights are controlled by the processor based on activities of an occupant in the hood.

18. The assembly of claim 11 wherein the communications device is configured to link a portable electronic device supported by the support device to at least one of an input device and an output device so that the at least one of an input device and an output device operates as an input device or an output device for the portable electronic device, respectively.

19. The assembly of claim 18 wherein the at least one of an input device and an output device includes at least one of a light device mounted to the hood for illuminating at least a portion of the space within the cavity, a microphone, a speaker, and a camera.

20. A hood assembly for supporting a portable electronic device having a display screen in a viewable position, the assembly comprising:

a hood coupled to a base, the hood including a wall structure that includes an internal surface that forms a substantially downwardly opening cavity, the cavity including a front portion and a rear portion, the cavity opening circumscribed by a lower edge that has a front edge portion adjacent the front portion of the cavity;

a support device supported within the hood and adjacent the front edge portion, the support device configured to receive and support the portable electronic device with the device display screen disposed at an oblique angle to the internal surface such that the display screen is facing and in a line of sight of a user within the hood and blocked from a line of sight from outside of the hood when the hood is in a viewing position; and a communications device provided in at least one of the hood and the base, and wherein the communications device is configured to communicate with the portable electronic device wherein the communications device comprises a wireless transceiver coupled within the hood, the transceiver having a sensing field restricted to the space of the cavity.

* * * * *